US007527356B2

(12) United States Patent
Sato

(10) Patent No.: US 7,527,356 B2
(45) Date of Patent: May 5, 2009

(54) DEVICE PACKAGE STRUCTURE, DEVICE PACKAGING METHOD, LIQUID DROP EJECTION METHOD, CONNECTOR, AND SEMICONDUCTOR DEVICE

(75) Inventor: Eiichi Sato, Okaya (JP)

(73) Assignee: Seiko Epson Corporation (JP)

( * ) Notice: Subject to any disclaimer, the term of this patent is extended or adjusted under 35 U.S.C. 154(b) by 494 days.

(21) Appl. No.: 11/370,018

(22) Filed: Mar. 6, 2006

(65) Prior Publication Data

US 2006/0234534 A1 Oct. 19, 2006

(30) Foreign Application Priority Data

| | | |
|---|---|---|
| Mar. 9, 2005 | (JP) | 2005-066087 |
| Mar. 9, 2005 | (JP) | 2005-066088 |
| Mar. 9, 2005 | (JP) | 2005-066089 |
| Dec. 20, 2005 | (JP) | 2005-366243 |

(51) Int. Cl.
*B41J 2/14* (2006.01)
*B41J 2/16* (2006.01)

(52) U.S. Cl. ..... 347/50; 347/68

(58) Field of Classification Search ..... 347/50, 347/56–59, 68–71
See application file for complete search history.

(56) References Cited

U.S. PATENT DOCUMENTS 6,471,342 B1 * 10/2002 Horio et al. ..... 347/70
6,619,785 B1 9/2003 Sato
2003/0117464 A1 * 6/2003 Miyata ..... 347/71

FOREIGN PATENT DOCUMENTS

| | | |
|---|---|---|
| JP | H11-297406 | 10/1999 |
| JP | 2000-031617 | 1/2000 |
| JP | 2001-189414 | 7/2001 |
| JP | 2001-291822 | 10/2001 |
| JP | 2002-110269 | 4/2002 |
| JP | 2003-069181 | 3/2003 |
| JP | 2003-159800 | 6/2003 |
| JP | 2004-284176 | 10/2004 |
| TW | 555653 | 10/2003 |
| WO | WO 96/03788 | 2/1996 |
| WO | WO 00/59074 | 10/2000 |

* cited by examiner

*Primary Examiner*—Juanita D Stephens
(74) *Attorney, Agent, or Firm*—Harness, Dickey & Pierce, P.L.C.

(57) ABSTRACT

A device package structure includes: a base body having a depression portion and a conductive connection portion formed in the depression portion; a device having a connection terminal; and a connector having a plate portion having a first surface on which the device is positioned, a protruding portion protruding from the first surface of the plate portion and having a second surface different from the first surface, a terminal electrode formed on the second surface, and a connection wiring electrically connecting the connection terminal of the device and the terminal electrode, wherein the protruding portion of the connector is inserted into the depression portion of the base body, the terminal electrode is connected to the conductive connection portion, and the conductive connection portion is electrically connected to the connection terminal of the device.

14 Claims, 16 Drawing Sheets

DEVICE PACKAGE STRUCTURE, DEVICE PACKAGING METHOD, LIQUID DROP EJECTION METHOD, CONNECTOR, AND SEMICONDUCTOR DEVICE

CROSS-REFERENCE TO RELATED APPLICATION

This application claims priority to Japanese Patent Application No. 2005-066087, filed Mar. 9, 2005, Japanese Patent Application No. 2005-066088, filed Mar. 9, 2005, Japanese Patent Application No. 2005-066089, filed Mar. 9, 2005, and Japanese Patent Application No. 2005-366243, filed Dec. 20, 2005, the contents of which are incorporated herein by reference.

BACKGROUND

1. Technical Field

The present invention relates to a device package structure, a device packaging method, a liquid drop ejection head, a connector, and a semiconductor device.

2. Related Art

The wire bonding method is known and widely used as a method of placing and electrically connecting an IC chip or other driver device on a circuit board. For example, as described in Japanese Unexamined Patent Application, First Publication No. 2003-159800 and Japanese Unexamined Patent Application, First Publication No. 2004-284176, technology is disclosed for applying a liquid droplet ejection method (inkjet method) in the formation of images and manufacture of microdevices, in the liquid droplet ejection head (inkjet method recording head) used in this technology, the wire bonding method is used to connect a piezoelectric element to effect ink ejection with a driver circuit portion (IC chip or the like) to supply electrical signals to the piezoelectric element.

However, the above-described technology of the prior art has the following problems.

With the higher integration densities of IC chips and similar in recent years, there has been a tendency for the external connection terminals of IC chips and similar to be smaller and spaced at narrower pitches, and accompanying this is a tendency for narrower pitches in the wiring patterns formed on circuit boards as well. Consequently, it has become difficult to apply connection methods which use wire bonding.

Furthermore, in order for a method of image formation or microdevice manufacture based on a liquid drop ejection method to realize high-resolution images and finely detailed microdevices, it is desirable that the distance between nozzle apertures (nozzle pitch) provided in the liquid drop ejection head be made as small (closely spaced) as possible. Because a plurality of piezoelectric elements are formed corresponding to nozzle apertures, if the nozzle pitch is reduced, the distance between piezoelectric elements must also be reduced in conformance with the nozzle pitch. However, if the distance between piezoelectric elements is thus reduced, it becomes different to use the wire bonding method to connect the driver ICs of the plurality of piezoelectric elements.

SUMMARY

An advantage of some aspects of the invention is to provide a device package structure for electrical connection of the connection terminals of an IC chip or other device with the connection portions of a substrate onto which the device is packaged, via level difference portions due to the device and level difference portions arising from the shape of the substrate. The advantage of some aspects of the invention is to provide a device package structure, liquid drop ejection head, and connector that enable device packaging with excellent reliability and high production yields, without detracting from workability when making electrical connections, even at narrower pitches for connection terminals and connection portions. Furthermore, the invention is to provide a method for packaging devices with excellent reliability and high production yields.

A first aspect of the invention provides a device package structure, including: a base body having a depression portion and a conductive connection portion formed in the depression portion; a device having a connection terminal; and a connector having a plate portion having a first surface on which the device is positioned, a protruding portion protruding from the first surface of the plate portion and having a second surface different from the first surface, a terminal electrode formed on the second surface, and a connection wiring electrically connecting the connection terminal of the device and the terminal electrode, the protruding portion of the connector is inserted into the depression portion of the base body, the terminal electrode is connected to the conductive connection portion, and the conductive connection portion is electrically connected to the connection terminal of the device.

Hence, in the device package structure of this invention, when packaging a semiconductor device or various other devices on a base body, by inserting the protruding portion into the depression portion, the terminal electrode is connected to the conductive connection portion. It is possible to electrically connect the conductive connection portion and the connection terminal of the device via the terminal electrode and connection wiring. Even when a depression portion or other level difference portion is formed in the surface of the base body, by using a connector having a protruding portion, it is possible to electrically connect the conductive connection portion formed on the bottom of the depression portion and the connection terminal of the device. Hence, when packaging a semiconductor device or various other devices onto the base body, it is possible to resolve the problem of a depression portion or other level difference portion by an extremely simple configuration. Consequently, the device package structure of this invention enables efficient, reliable, and low-cost device packaging. In this invention, the connector is formed by forming the terminal electrode, connection wiring or other wiring on only the first surface of the connector, so that it is possible to improve the efficiency of connector manufacture. Furthermore, in this invention, the conductive connection portion and device connection terminal are electrically connected by a single operation for connecting the device terminal electrode and the conductive connection portion, so that it is possible to perform the packaging process effectually.

It is preferable that, in the device package structure of the first aspect of the invention, a height from the first surface of the plate portion to the second surface of the protruding portion be greater than a depth of the depression portion.

According to this invention, when inserting the protruding portion into the depression portion, it is possible to avoid contacting between the device and the base body.

It is preferable that the device package structure of the first aspect of the invention, further include: an external substrate; and a wiring terminal formed on the first surface of the plate portion and electrically connecting the device and the external substrate.

Hence, in this invention, it is possible to connect a control substrate or other external substrate to the connector.

It is preferable that, in the device package structure of the first aspect of the invention, the connector have an inclined surface between the first surface of the plate portion and the second surface of the protruding portion, and the connection wiring be formed on the inclined surface.

According to this invention, the angle of inclination of the inclined surface with respect to the first surface becomes obtuse. Furthermore, the angle of the inclined surface with respect to the second surface becomes obtuse. It is possible to abate a concentration of stress acting on the connection wiring formed on the inclined surface, and it is possible to avoid breaking of wirings and other problems. In addition, when for example fabricating a connection wiring film for a liquid drop ejection method, it is easier to fabricate a connection wiring film compared with a case of fabricating a connection wiring film on two mutually orthogonal surfaces.

It is preferable that the device package structure of the first aspect of the invention, further include: a conductive protuberance formed on the terminal electrode.

Here, a "conductive protuberance" means a bump. In this configuration, it is possible to absorb dispersion of a height of the connector during packaging of the connector on the base body (for example, flip-chip packaging). Moreover, compared with the case of forming a bump on the base body, it is possible to form bumps during formation of terminal electrodes and connection wiring, so that manufacturing is facilitated.

It is preferable that, in the device package structure of this invention, the material of the terminal electrode be any one among: a metal material selected from among Cu, Ni, Au, and Ag; an alloy of metal materials selected from this group; a brazing metal; and a conductive resin material.

It is preferable that, in the device package structure of this invention, the base material of the connector be a glass epoxy, Si, a ceramic, an engineering plastic, or a glass.

It is preferable that, in the device package structure of the first aspect of the invention, a linear expansion coefficient of the base body and a linear expansion coefficient of the connector be substantially the same.

Even when temperature fluctuations occur in the base body and connector, it is possible to prevent separation of conductive joint portions due to changes in volume caused by temperature changes.

It is preferable that the device package structure of the first aspect of the invention, further include: a conductive protuberance formed on the connection terminal of the device.

According to this invention, it is possible to package the device on the connector using flip-chip packaging. Hence, it is possible to perform the process of packaging the device on the connector, and the process of packaging the connector on the base body, using the same equipment (packaging equipment), so that it is possible to increase production efficiency.

It is preferable that the device package structure of the first aspect of the invention, further include: a resin formed between the first surface of the connector and the base body.

According to this invention, the connector and base body are sealed by the resin. It is possible to suppress moisture absorption by the conductive connection portion and device, and it is possible to improve the reliability of the conductive connection portion.

A second aspect of the invention provides a liquid drop ejection head, including: a nozzle aperture ejecting liquid drops; a pressure generation chamber communicating with the nozzle aperture; a driving element arranged outside of the pressure generation chamber, having a circuit connection portion, and generating a pressure change in the pressure generation chamber; a protective substrate provided on an opposite side of the pressure generation chamber in relation to the driving element; and a driving circuit section, provided on an opposite side of the driving element in relation to the protective substrate, supplying electrical signals to the driving element, the circuit connection portion is electrically connected to the driving circuit section by using the above described device package structure.

In the liquid drop ejection head of this invention, a driving circuit section and a driving element positioned on either side with a protective substrate intervening, are connected by the connector. Even when the driving element is made small by a smaller nozzle aperture and when connection using wire bonding is extremely difficult, the circuit connection portion can easily be made small, and simple connection of the driving element and driving circuit section is possible with high connection reliability, so that it is possible to provide a finely detailed liquid drop ejection head.

In the case of a structure which employs wire bonding for connection, space is required to draw out the wirings; but in the liquid drop ejection head of this invention, such space is unnecessary, and it is possible to achieve the liquid drop ejection head be thin. Furthermore, the driving circuit section is structured for packaging on a protective substrate, which is advantageous for realizing a thin and compact liquid drop ejection head overall, including the driving circuit section.

A third aspect of the invention provides a semiconductor device, including: a base body; and an electronic device packaged on the base body by using the above described device package structure.

In this invention, a semiconductor device can be provided which is compact and highly reliable, and is provided with a package structure with excellent electrical reliability.

A fourth aspect of the invention provides a connector, including: a device having a connection terminal; a plate portion having a first surface on which the device is positioned; a protruding portion protruding from the first surface of the plate portion, and having a second surface different from the first surface; a terminal electrode formed on the second surface; and a connection wiring electrically connecting the connection terminal of the device and the terminal electrode.

Here, even when a depression or other level difference portion is formed on the surface of the base body, and the connection terminal of the device is at a distance from the conductive connection portion of the base body, by using a connector of this invention, it is possible to electrically connect the connection terminal of the device and the conductive connection portion of the base body. Hence, when packaging a semiconductor device or various other devices on a base body, it is possible to resolve problems arising when there is a depression or other level difference portion, by an extremely simple configuration. The device can be packaged efficiently, reliably, and at low cost.

It is preferable that the connector of the fourth aspect of the invention, further include: an inclined surface between the first surface of the plate portion and the second surface of the protruding portion, the connection wiring be formed on the inclined surface.

In this invention, the angle of inclination of the inclined surface with respect to the first surface becomes obtuse. Furthermore, the angle of the inclined surface with respect to the second surface becomes obtuse. It is possible to abate a concentration of stress acting on the connection wiring formed on the inclined surface, and it is possible to avoid breaking of wirings and other problems. In addition, when for example fabricating a connection wiring film for a liquid drop ejection method, it is easier to fabricate a connection wiring film compared with a case of fabricating a connection wiring film on two mutually orthogonal surfaces.

It is preferable that the connector of the fourth aspect of the invention, further include: a conductive protuberance formed on the terminal electrode.

Here, a "conductive protuberance" means a bump. In this configuration, it is possible to absorb dispersion of a height of the connector during packaging of the connector on the base body (for example, flip-chip packaging). Moreover, compared with the case of forming a bump on the base body, it is possible to form bumps during formation of terminal electrodes and connection wiring, so that manufacturing is facilitated.

It is preferable that the connector of the fourth aspect of the invention, further include: a conductive protuberance formed on the connection terminal of the device.

According to this invention, it is possible to package the device on the connector using flip-chip packaging. Hence, it is possible to perform the process of packaging the device on the connector, and the process of packaging the connector on the base body, using the same equipment (packaging equipment), so that it is possible to increase production efficiency.

A fifth aspect of the invention provides a device packaging method, including: preparing a base body having a depression portion and a conductive connection portion formed in the depression portion; preparing a device having a connection terminal; forming a connector having a plate portion having a first surface on which the device is positioned, a protruding portion protruding from the first surface of the plate portion and having a second surface different from the first surface, a terminal electrode formed on the second surface, and a connection wiring electrically connecting the connection terminal of the device and the terminal electrode; connecting the terminal electrode and the conductive connection portion by inserting the protruding portion into the depression portion; and electrically connecting the conductive connection portion and the connection terminal of the device.

Hence, in the device packaging method of this invention, when packaging a semiconductor device or various other devices on the base body, by inserting the protruding portion into the depression portion the terminal electrode is connected to the conductive connection portion. It is possible to electrically connect the conductive connection portion and the connection terminal of the device via the terminal electrode and connection wiring. Even when there is a depression or other level difference portion in the surface of the base body, by using a connector having a protruding portion, it is possible to electrically connect the conductive connection portion formed on the bottom of the depression portion and the connection terminal of the device. Hence, when packaging a semiconductor device or various other devices on a base body, it is possible to resolve the problem of a depression portion or other level difference portion by an extremely simple configuration. Consequently, the device packaging method of this invention enables efficient, reliable, and low-cost device packaging. In this invention, the connector is formed merely by forming the terminal electrode, connection wiring or other wiring on only the first surface of the connector, so that it is possible to improve the efficiency of connector manufacture. Furthermore, in this invention, the conductive connection portion and device connection terminal are electrically connected by a single operation to connect the device terminal electrode and the conductive connection portion, so that it is possible to perform the packaging process effectually.

It is preferable that the device packaging method of the fifth aspect of the invention, further include: packaging the device on the plate portion.

As the packaging method, it is preferable that flip-chip packaging be used.

According to this invention, it is possible to perform the process of packaging the device on the connector, and the process of packaging the connector on the base body, using the same equipment (packaging equipment), so that it is possible to increase production efficiency.

A sixth aspect of the invention provides a device package structure, including: a base body having a depression portion and a conductive connection portion formed in the depression portion; a device having a connection terminal; and a connector having a plate portion having a first surface on which the device is positioned, a back surface of an opposite side of the first surface, a connection electrode formed on the back surface, a protruding portion protruding from the first surface of the plate portion and having a second surface different from the first surface, a terminal electrode formed on the second surface, a first connection wiring electrically connecting the connection terminal of the device and the terminal electrode, and a second connection wiring electrically connecting the connection terminal of the device and the connection electrode, the protruding portion of the connector is inserted into the depression portion of the base body, the terminal electrode is connected to the conductive connection portion, and the conductive connection portion is electrically connected to the connection terminal of the device.

Hence, when packaging a semiconductor device or various other devices on the base body in the device package structure of this invention, by inserting the protruding portion into the depression portion, the terminal electrode is connected to the conductive connecting portion. It is possible to electrically connect the conductive connection portion and the connection terminal of the device via the terminal electrode and the first connection wiring. Even when a depression or other level difference portion is formed in the surface of the base body, by using a connector having a protruding portion, it is possible to electrically connect the conductive connection portion formed on the bottom of the depression portion and the connection terminal of the device. Hence, when packaging a semiconductor device or various other devices on the base body, it is possible to resolve the problem of a depression portion or other level difference portion by an extremely simple configuration. Consequently, the device package structure of this invention enables efficient, reliable, and low-cost device packaging. In this invention, the conductive connection portion and device connection terminal are electrically connected by a single operation to connect the device terminal electrode and the conductive connection portion, so that it is possible to perform the packaging process effectually.

In the device package structure of this invention, an electrical connection between a controller or other external equipment and the device is made by the connection electrode formed on the back surface of the plate portion, via the second connection wiring. Hence, the flexible substrate or other substrate connected to the external equipment does not project outward on the side of the connector. As a result, it is possible to achieve the connector be compact. Moreover, it is possible to reduce the size of device packaging for a liquid drop ejection head or the like.

It is preferable that the device package structure of the sixth aspect of the invention, further include: a penetrating hole penetrating the plate portion, at least a portion of the second connection wiring be formed in the penetrating hole.

It is preferable that, in the device package structure of the sixth aspect of the invention, at least a portion of the second connection wiring be formed on a side surface of the plate portion.

When the second connection wiring is formed in the penetrating hole, it is possible to shorten the length of wiring between the device connection terminal and the connection electrode. On the other hand, when the second connection wiring is formed on a side surface of the plate portion, there is no longer a need to form a penetrating hole or the like.

It is preferable that, in the device package structure of the sixth aspect of the invention, a height from the first surface of the plate portion to the second surface of the protruding portion be greater than a depth of the depression portion.

According to this invention, when the protruding portion is inserted into the depression portion, it is possible to avoid contacting between the device and the base body.

It is preferable that, in the device package structure of the sixth aspect of the invention, the connector have an inclined surface between the first surface of the plate portion and the second surface of the protruding portion, and the first connection wiring be formed on the inclined surface.

According to this invention, the angle of inclination of the inclined surface with respect to the first surface is obtuse. Furthermore, the angle of the inclined surface with respect to the second surface is obtuse. It is possible to abate a concentration of stress acting on the connection wiring formed on the inclined surface, and it is possible to avoid breaking of wirings and other problems. In addition, when for example fabricating a connection wiring film for a liquid drop ejection method, it is easier to fabricate a connection wiring film compared with a case of fabricating a connection wiring film on two mutually orthogonal surfaces.

It is preferable that the device package structure of the sixth aspect of the invention, further include: a conductive protuberance formed on the terminal electrode.

Here, a "conductive protuberance" means a bump. In this configuration, it is possible to absorb dispersion of a height of the connector during packaging of the connector on the base body (for example, flip-chip packaging). Moreover, compared with the case of forming a bump on the base body, it is possible to form bumps during formation of terminal electrodes and connection wiring, so that manufacturing is facilitated.

It is preferable that in the device package structure of this invention, the material of the terminal electrode be any one among: a metal material selected from among Cu, Ni, Au, and Ag; an alloy of metal materials selected from this group; a brazing metal; and a conductive resin material.

It is preferable that in the device package structure of this invention, the base material of the connector be a glass epoxy, Si, a ceramic, an engineering plastic, or a glass.

It is preferable that, in the device package structure of the sixth aspect of the invention, a linear expansion coefficient of the base body and a linear expansion coefficient of the connector be substantially the same.

Even when temperature fluctuations occur in the base body and connector, it is possible to prevent separation of conductive joint portions due to changes in volume caused by temperature changes.

It is preferable that the device package structure of the sixth aspect of the invention, further include: a conductive protuberance formed on the connection terminal of the device.

According to this invention, it is possible to package the device on the connector using flip-chip packaging. Hence, it is possible to perform the process of packaging the device on the connector, and the process of packaging the connector on the base body, using the same equipment (packaging equipment), so that it is possible to increase production efficiency.

It is preferable that the device package structure of the sixth aspect of the invention, further include: a resin formed between the first surface of the connector and the base body.

According to this invention, the connector and base body are sealed by the resin. It is possible to suppress moisture absorption by the conductive connection portion and device, and it is possible to improve the reliability of the conductive connection portion.

A seventh aspect of the invention provides a device package structure, including: a nozzle aperture ejecting liquid drops; a pressure generation chamber communicating with the nozzle aperture; a driving element arranged outside of the pressure generation chamber, having a circuit connection portion, and generating a pressure change in the pressure generation chamber; a protective substrate provided on an opposite side of the pressure generation chamber in relation to the driving element; and a driving circuit section, provided on an opposite side of the driving element in relation to the protective substrate, supplying electrical signals to the driving element, the circuit connection portion is electrically connected to the driving circuit section by using the above described device package structure.

In a liquid drop ejection head of this invention, a driving circuit section and a driving element positioned on either side with a protective substrate intervening, are connected by a connector. Even when the driving element is made small by a smaller nozzle aperture and when connection using wire bonding is extremely difficult, the circuit connection portion can easily be made small, and simple connection of the driving element and driving circuit section is possible with high connection reliability, so that it is possible to provide a finely detailed liquid drop ejection head.

In the case of a structure which employs wire bonding for connection, space is required to draw out the wirings; but in the liquid drop ejection head of this invention, such space is unnecessary, and it is possible to achieve the liquid drop ejection head be thin. Furthermore, the driving circuit section is structured for packaging on a protective substrate, which is advantageous for realizing a thin and compact liquid drop ejection head overall, including the driving circuit section.

In the liquid drop ejection head of this invention, the controller or other external equipment and the device are electrically connected using a connection electrode formed on the back surface of the plate portion, via the second connection wiring. Hence, the flexible substrate or other substrate connected to the external equipment does not project outward on the side of the connector. As a result, it is possible to achieve the connector be compact. Moreover, it is possible to reduce the size of device packaging for a liquid drop ejection head or the like.

An eighth aspect of the invention provides a semiconductor device, including: a base body; and an electronic device packaged on the base body by using the above described device package structure.

In this invention, a semiconductor device can be provided which is compact and highly reliable, and is provided with a package structure with excellent electrical reliability.

A ninth aspect of the invention provides a connector, including: a device having a connection terminal; a plate portion having a first surface on which the device is positioned, and having a back surface of an opposite side of the first surface; a connection electrode formed on the back surface; a protruding portion protruding from the first surface of the plate portion and having a second surface different from the first surface; a terminal electrode formed on the second surface; a first connection wiring electrically connecting the connection terminal of the device and the terminal electrode; and, a second connection wiring electrically connecting the connection terminal of the device and the connection electrode.

Here, even when a depression or other level difference portion is formed on the surface of the base body, and the connection terminal of the device is at a distance from the conductive connection portion of the base body, by using a connector of this invention it is possible to electrically connect the connection terminal of the device and the conductive connection portion of the base body. Hence, when packaging a semiconductor device or various other devices on a base body, it is possible to resolve problems arising when there is a depression or other level difference portion, by an extremely simple configuration. The device can be packaged efficiently, reliably, and at low cost.

In the connector of this invention, an electrical connection between a controller or other external equipment and the device is made by the connection electrode formed on the back surface of the plate portion, via the second connection wiring. Hence, the flexible substrate or other substrate connected to the external equipment does not project outward on the side of the connector. As a result, it is possible to achieve the connector be compact. Moreover, it is possible to reduce the size of device packaging for a liquid drop ejection head or the like.

It is preferable that the connector of the ninth aspect of the invention, further include: a penetrating hole penetrating the plate portion, at least a portion of the second connection wiring be formed in the penetrating hole.

It is preferable that, in the connector of the ninth aspect of the invention, at least a portion of the second connection wiring be formed on a side surface of the plate portion.

When the second connection wiring is formed in the penetrating hole, it is possible to shorten the length of wiring between the device connection terminal and the connection electrode. On the other hand, when the second connection wiring is formed on a side surface of the plate portion, there is no longer a need to form a penetrating hole or the like.

It is preferable that the connector of the ninth aspect of the invention, further include: an inclined surface between the first surface of the plate portion and the second surface of the protruding portion, the first connection wiring be formed on the inclined surface.

In this invention, the angle of inclination of the inclined surface with respect to the first surface is obtuse. Furthermore, the angle of the inclined surface with respect to the second surface is obtuse. It is possible to abate a concentration of stress acting on the connection wiring formed on the inclined surface, and it is possible to avoid breaking of wirings and other problems. In addition, when for example fabricating a connection wiring film for a liquid drop ejection method, it is easier to fabricate a connection wiring film compared with a case of fabricating a connection wiring film on two mutually orthogonal surfaces.

It is preferable that the connector of the ninth aspect of the invention, further include: a conductive protuberance formed on the terminal electrode.

Here, a "conductive protuberance" means a bump. In this configuration, it is possible to absorb dispersion of a height of the connector during packaging of the connector on the base body (for example, flip-chip packaging). Moreover, compared with the case of forming a bump on the base body, it is possible to form bumps during formation of terminal electrodes and connection wiring, so that manufacturing is facilitated.

It is preferable that the connector of the ninth aspect of the invention, further include: a conductive protuberance formed on the connection terminal of the device.

According to this invention, it is possible to package the device on the connector using flip-chip packaging. Hence, it is possible to perform the process of packaging the device on the connector, and the process of packaging the connector on the base body, using the same equipment (packaging equipment), so that it is possible to increase production efficiency.

A tenth aspect of the invention provides a device packaging method, including: preparing a base body having a depression portion and a conductive connection portion formed in the depression portion; preparing a device having a connection terminal; forming a connector having a plate portion having a first surface on which the device is positioned, a back surface of an opposite side of the first surface, a connection terminal formed on the back surface, a protruding portion protruding from the first surface of the plate portion and having a second surface different from the first surface, a terminal electrode formed on the second surface, a first connection wiring electrically connecting the connection terminal of the device to the terminal electrode, and a second connection wiring electrically connecting the connection terminal of the device to the connection electrode; connecting the terminal electrode and the conductive connection portion by inserting the protruding portion into the depression portion; and electrically connecting the conductive connection portion and the connection terminal of the device.

Hence, in the device packaging method of this invention, when packaging a semiconductor device or various other devices on the base body, by inserting the protruding portion into the depression portion the terminal electrode is connected to the conductive connection portion. It is possible to electrically connect the conductive connection portion and the connection terminal of the device via the terminal electrode and first connection wiring. Even when there is a depression or other level difference portion in the surface of the base body, by using a connector having a protruding portion, it is possible to electrically connect the conductive connection portion formed on the bottom of the depression portion and the connection terminal of the device. Hence, when packaging a semiconductor device or various other devices on a base body, it is possible to resolve the problem of a depression portion or other level difference portion by an extremely simple configuration. Consequently, the device packaging method of this invention enables efficient, reliable, and low-cost device packaging. In this invention, the conductive connection portion and device connection terminal are electrically connected by a single operation to connect the device terminal electrode and the conductive connection portion, so that it is possible to perform the packaging process effectually.

In the device packaging method of this invention, an electrical connection between a controller or other external equipment and the device is made by the connection electrode formed on the back surface of the plate portion, via the second connection wiring. Hence, the flexible substrate or other substrate connected to the external equipment does not project outward on the side of the connector. As a result, it is possible to achieve the connector be compact. Moreover, it is possible to reduce the size of device packaging for a liquid drop ejection head or the like.

It is preferable that the device packaging method of the tenth aspect of the invention, further include: packaging the device on the plate portion.

Here, it is preferable that flip-chip packaging be used as the packaging method.

According to this invention, it is possible to perform the process of packaging the device on the connector, and the process of packaging the connector on the base body, using the same equipment (packaging equipment), so that it is possible to increase production efficiency.

An eleventh aspect of the invention provides a device package structure, including: a base body, having a depression portion, a plurality of conductive connection portions formed in the depression portion, and a first inner wall surface and a second inner wall surface that are formed in the depression portion; a device having a plurality of connection terminals; and a connector having a plate portion having a first surface on which the device is positioned, a protruding portion protruding from the first surface of the plate portion and having a second surface different from the first surface, a plurality of terminal electrodes formed on the second surface, a plurality of connection wirings each of which electrically connecting each of the plurality of the connection terminals of the device and each of the plurality of the terminal electrodes, and a first contact surface and a second contact surface that are different from the surface on which the plurality of the connection wirings are formed, the protruding portion of the connector is inserted into the depression portion of the base body, each of the plurality of the terminal electrodes is connected to each of the plurality of the conductive connection portions, and each of the plurality of the conductive connection portions is electrically connected to each of the plurality of the connection terminals of the device.

Hence, in the device package structure of this invention, when packaging a semiconductor device or various other devices on a base body, by inserting the protruding portion into the depression portion the terminal electrode is connected to the conductive connection portion. It is possible to electrically connect the conductive connection portion and the connection terminal of the device via the terminal electrode and connection wiring. Even when a depression portion or other level difference portion is formed in the surface of the base body, by using a connector having a protruding portion, it is possible to electrically connect the conductive connection portion formed on the bottom of the depression portion and the connection terminal of the device. Hence, when packaging a semiconductor device or various other devices onto the base body, it is possible to resolve the problem of a depression portion or other level difference portion by an extremely simple configuration. Consequently, the device package structure of this invention enables efficient, reliable, and low-cost device packaging. In this invention, the connector is formed by forming the terminal electrode, connection wiring or other wiring on only the first surface of the connector, so that it is possible to improve the efficiency of connector manufacture. Furthermore, in this invention, the conductive connection portion and device connection terminal are electrically connected by a single operation to connect the device terminal electrode and the conductive connection portion, so that it is possible to perform the packaging process effectually.

It is preferable that, in the device package structure of the eleventh aspect of the invention, the connector and the base body be positioned at the position at which the first inner wall surface contact to the first contact surface, or at the position at which the second inner wall surface contact to the second contact surface, each of the plurality of the terminal electrodes be connected to each the plurality of the conductive connection portions, and each of the plurality of the conductive connection portions be electrically connected to each of the plurality of the connection terminals of the device.

Here, when the first inner wall surface and the first contact surface make contact, the second inner wall surface and the second contact surface are not in contact. On the other hand, when the second inner wall surface and the second contact surface are in contact, the first inner wall surface and the first contact surface are not in contact.

According to this invention, by contacting the first inner wall surface (or second inner wall surface) and the first contact surface (or second contact surface), it is possible to position the connector and base body, and it is possible to electrically connect the terminal electrode and conductive connection portion.

Such a structure has the following advantages.

For example, if a single wafer is divided into a plurality of base bodies for purposes of manufacturing efficiency, there may be cases in which two types of base body are manufactured, with the center of a group of conductive connection portions formed, shifted in one direction, on the bottom surface of the depression portion (with the group of conductive connection portions shifted to the right side in some cases, and shifted to the left side in other cases). Even in such cases in which the group of conductive connection portions formed on the bottom surface of the depression portion are shifted in one direction, by contacting the first inner wall surface and the first contact surface, or by contacting the second inner wall surface and the second contact surface, it is possible to position the connector and base body, and it is possible to electrically connect the terminal electrodes and conductive connection portions.

It is preferable that, in the device package structure of the eleventh aspect of the invention, the first inner wall surface and the second inner wall surface be formed at an inclination from the bottom surface of the depression portion, and the first contact surface and the second contact surface be formed at an inclination from the first surface.

According to this invention, when inserting the protruding portion into the depression portion to connect the terminal electrodes to the conductive connection portions, the first inner wall surface and the first contact surface do not catch, or the second inner wall surface and the second contact surface do not catch. Hence, the protruding portion can easily be inserted into the depression portion.

It is preferable that, in the device package structure of the eleventh aspect of the invention, a height from the first surface of the plate portion to the second surface of the protruding portion be greater than a depth of the depression portion.

According to this invention, when the protruding portion is inserted into the depression portion, it is possible to avoid contacting between the device and the base body.

It is preferable that, in the device package structure of the eleventh aspect of the invention, the connector have an inclined surface between the first surface of the plate portion and the second surface of the protruding portion, and the plurality of the connection wirings be formed on the inclined surface.

According to this invention, the angle of inclination of the inclined surface with respect to the first surface is obtuse. Furthermore, the angle of the inclined surface with respect to the second surface is obtuse. It is possible to abate a concentration of stress acting on the connection wiring formed on the inclined surface, and it is possible to avoid breaking of wirings and other problems. In addition, when for example fabricating a connection wiring film for a liquid drop ejection method, it is easier to fabricate a connection wiring film compared with a case of fabricating a connection wiring film on two mutually orthogonal surfaces.

It is preferable that the device package structure of the eleventh aspect of the invention, further include: a plurality of conductive protuberances formed on the terminal electrode.

Here, a "conductive protuberance" means a bump. In this configuration, it is possible to absorb dispersion of a height of the connector during packaging of the connector on the base body (for example, flip-chip packaging). Moreover, compared with the case of forming a bump on the base body, it is possible to form bumps during formation of terminal electrodes and connection wiring, so that manufacturing is facilitated.

It is preferable that in the device package structure of this invention, the material of the terminal electrode be any one among: a metal material selected from among Cu, Ni, Au, and Ag; an alloy of metal materials selected from this group; a brazing metal; and a conductive resin material.

It is preferable that in the device package structure of this invention, the base material of the connector be a glass epoxy, Si, a ceramic, an engineering plastic, or a glass.

It is preferable that, in the device package structure of the eleventh aspect of the invention, a linear expansion coefficient of the base body and a linear expansion coefficient of the connector be substantially the same.

Even when temperature fluctuations occur in the base body and connector, it is possible to prevent separation of conductive joint portions due to changes in volume caused by temperature changes.

It is preferable that the device package structure of the eleventh aspect of the invention, further include: a plurality of conductive protuberances formed on the connection terminal of the device.

According to this invention, it is possible to package the device on the connector using flip-chip packaging. Hence, it is possible to perform the process of packaging the device on the connector, and the process of packaging the connector on the base body, using the same equipment (packaging equipment), so that it is possible to increase production efficiency.

It is preferable that the device package structure of the eleventh aspect of the invention, further include: a resin formed between the first surface of the connector and the base body.

According to this invention, the connector and base body are sealed by the resin. It is possible to suppress moisture absorption by the conductive connection portion and device, and it is possible to improve the reliability of the conductive connection portion.

A twelfth aspect of the invention provides a liquid drop ejection head, including: a nozzle aperture ejecting liquid drops; a pressure generation chamber communicating with the nozzle aperture; a driving element arranged outside of the pressure generation chamber, having a circuit connection portion, and generating a pressure change in the pressure generation chamber; a protective substrate provided on an opposite side of the pressure generation chamber in relation to the driving element; and a driving circuit section, provided on an opposite side of the driving element in relation to the protective substrate, supplying electrical signals to the driving element, the circuit connection portion is electrically connected to the driving circuit section by using the above described device package structure.

In a liquid drop ejection head of this invention, a driving circuit section and a driving element positioned on either side with a protective substrate intervening, are connected by a connector. Even when the driving element is made small by a smaller nozzle aperture and when connection using wire bonding is extremely difficult, the circuit connection portion can easily be made small, and simple connection of the driving element and driving circuit section is possible with high connection reliability, so that it is possible to provide a finely detailed liquid drop ejection head.

In the case of a structure which employs wire bonding for connection, space is required to draw out the wirings; but in the liquid drop ejection head of this invention, such space is unnecessary, and it is possible to achieve the liquid drop ejection head be thin. Furthermore, the driving circuit section is structured for packaging on a protective substrate, which is advantageous for realizing a thin and compact liquid drop ejection head overall, including the driving circuit section.

In the liquid drop ejection head of this invention, the connector and base body are positioned at the position at which the first inner wall surface and the first contact surface make contact, or at the position at which the second inner wall surface and the second contact surface make contact, so that the terminal electrode is connected to the conductive connection portion and a circuit connection portion is formed. According to this invention, a reliable connection can be made between the terminal electrode and the conductive connection portion.

A thirteenth aspect of the invention provides a semiconductor device, including: a base body, and an electronic device packaged on the base body by using the above described device package structure.

In this invention, a semiconductor device can be provided which is compact and highly reliable, and is provided with a package structure with excellent electrical reliability.

A fourteenth aspect of the invention provides a connector, including: a device having a plurality of connection terminals; a plate portion, having a first surface on which the device is positioned; a protruding portion protruding from the first surface of the plate portion, and having a second surface different from the first surface; a plurality of terminal electrodes formed on the second surface; a plurality of connection wirings, each of which electrically connecting each of the plurality of the connection terminals of the device, and each of the plurality of terminal electrodes; and a first contact surface and a second contact surface, different from the surface on which the plurality of the connection wirings are formed.

Here, even when a depression or other level difference portion is formed on the surface of the base body, and the connection terminals of the device are at a distance from the conductive connection portion of the base body, by using a connector of this invention, it is possible to electrically connect the connection terminals of the device and the conductive connection portion of the base body. Hence, when packaging a semiconductor device or various other devices on a base body, it is possible to resolve problems arising when there is a depression or other level difference portion, by an extremely simple configuration. The device can be packaged efficiently, reliably, and at low cost.

By using the connector of this invention, the connector and base body are positioned at the position at which the first inner wall surface and first contact surface are in contact, or at the position at which the second inner wall surface and second contact surface are in contact, the terminal electrodes are connected to the conductive connection portion, and the conductive connection portion and connection terminals of the device are electrically connected. According to this invention, it is possible to position the connector and base body, and it is possible to electrically connect the terminal electrodes and conductive connection portion, by contacting the first inner wall surface (or second inner wall surface) and the first contact surface (or second contact surface).

It is preferable that, in the connector of the fourteenth aspect of the invention, the first contact surface and the second contact surface be formed at an inclination from the first surface of the plate portion.

According to this invention, when inserting the protruding portion into the depression portion to connect the terminal electrodes to the conductive connection portion, the first inner wall surface and the first contact surface do not catch; or, the second inner wall surface and the second contact surface do not catch. Hence, the protruding portion can easily be inserted into the depression portion.

It is preferable that the connector of the fourteenth aspect of the invention, further include: an inclined surface between the first surface of the plate portion and the second surface of the protruding portion, the plurality of the connection wirings be formed on the inclined surface.

According to this invention, the angle of inclination of the inclined surface with respect to the first surface is obtuse. Furthermore, the angle of the inclined surface with respect to the second surface is obtuse. It is possible to abate a concentration of stress acting on the connection wiring formed on the inclined surface, and it is possible to avoid breaking of wirings and other problems. In addition, when for example fabricating a connection wiring film for a liquid drop ejection method, it is easier to fabricate a connection wiring film compared with a case of fabricating a connection wiring film on two mutually orthogonal surfaces.

It is preferable that the connector of the fourteenth aspect of the invention, further include: a plurality of conductive protuberances, each of which formed on each of the plurality of the terminal electrodes.

Here, a "conductive protuberance" means a bump. In this configuration, it is possible to absorb dispersion of a height of the connector during packaging of the connector on the base body (for example, flip-chip packaging). Moreover, compared with the case of forming a bump on the base body, it is possible to form bumps during formation of terminal electrodes and connection wiring, so that manufacturing is facilitated.

It is preferable that the connector of the fourteenth aspect of the invention, further include: a plurality of conductive protuberances, each of which formed on each of the plurality of the connection terminals of the device.

According to this invention, it is possible to package the device on the connector using flip-chip packaging. Hence, it is possible to perform the process of packaging the device on the connector, and the process of packaging the connector on the base body, using the same equipment (packaging equipment), so that it is possible to increase production efficiency.

A fifteenth aspect of the invention provides a device packaging method, including: preparing a base body having a depression portion, a plurality of conductive connection portions formed in the depression portion, and a first inner wall surface and second inner wall surface formed in the depression portion; preparing a device having a plurality of connection terminals; forming a connector having a plate portion having a first surface on which the device is positioned, a protruding portion protruding from the first surface of the plate portion and having a second surface different from the first surface, a plurality of terminal electrodes formed on the second surface, a plurality of connection wirings each of which electrically connecting each of the plurality of the connection terminals of the device and each of the plurality of the terminal electrodes, and a first contact surface and a second contact surface different from the surface on which the connection wirings are formed; inserting the protruding portion into the depression portion; contacting the first inner wall surface and the first contact surface, or contacting the second inner wall surface and the second contact surface; connecting each of the plurality of the terminal electrodes and each of the plurality of the conductive connection portions; and electrically connecting each of the plurality of the conductive connection portions and each of the plurality of the connection terminals of the device.

Hence, in the device packaging method of this invention, when packaging a semiconductor device or various other devices onto the base body, the terminal electrode is connected to the conductive connection portion by inserting the protruding portion into the depression portion. It is possible to electrically connect the conductive connection portion and the connection terminal of the device via the terminal electrode and connection wiring. Even when a depression portion or other level difference portion is formed in the surface of the base body, by using a connector having a protruding portion, it is possible to electrically connect the conductive connection portion formed on the bottom of the depression portion and the connection terminal of the device. Hence, when packaging a semiconductor device or various other devices onto the base body, it is possible to resolve the problem of a depression portion or other level difference portion by an extremely simple configuration. Consequently, the device package structure of this invention enables efficient, reliable, and low-cost device packaging. In this invention, the connector is formed by forming the terminal electrode, connection wiring or other wiring on only the first surface of the connector, so that it is possible to improve the efficiency of connector manufacture. Furthermore, in this invention, the conductive connection portion and device connection terminal are electrically connected by a single operation to connect the device terminal electrode and the conductive connection portion, so that it is possible to perform the packaging process effectually.

In the device packaging method of this invention, the connector and base body are positioned at the position at which the first inner wall surface and first contact surface are in contact, or at the position at which the second inner wall surface and second contact surface are in contact. The terminal electrode is then connected to the conductive connection portion, and the conductive connection portion and connection terminal of the device are electrically connected. Here, when the first inner wall surface and the first contact surface make contact, the second inner wall surface and second contact surface are not in contact. On the other hand, when the second inner wall surface and second contact surface make contact, the first inner wall surface and first contact surface are not in contact.

According to this invention, the connector and base body can be positioned, and the terminal electrode and conductive connection portion can be electrically connected, by contacting the first inner wall surface (or second inner wall surface) and the first contact surface (or second contact surface).

Such a structure has the following advantages.

For example, if a single wafer is divided into a plurality of base bodies for purposes of manufacturing efficiency, there may be cases in which two types of base body are manufactured, with the center of a group of conductive connection portions formed, shifted in one direction, on the bottom surface of the depression portion (with the group of conductive connection portions shifted to the right side in some cases, and shifted to the left side in other cases). Even in such cases in which the group of conductive connection portions formed on the bottom surface of the depression portion are shifted in one direction, by contacting the first inner wall surface and the first contact surface, or by contacting the second inner wall surface and the second contact surface, it is possible to position the connector and base body, and it is possible to electrically connect the terminal electrodes and conductive connection portions.

It is preferable that in the device package structure of this invention, a conductive protuberance be formed on the connection terminal of the device.

According to this invention, it is possible to package the device on the connector using flip-chip packaging. Hence, it is possible to perform the process of packaging the device on the connector, and the process of packaging the connector on the base body, using the same equipment (packaging equipment), so that it is possible to increase production efficiency.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, embodiments of a device package structure and device packaging method, liquid drop ejection head, connector, and semiconductor device of this invention are explained, referring to FIG. 1 through FIG. 16.

In each of the views referenced in the explanations, the dimensions of the constituent members are modified to facilitate understanding of the drawings, and some portions are omitted.

First Embodiment

Liquid Drop Ejection Head

Figure 1:
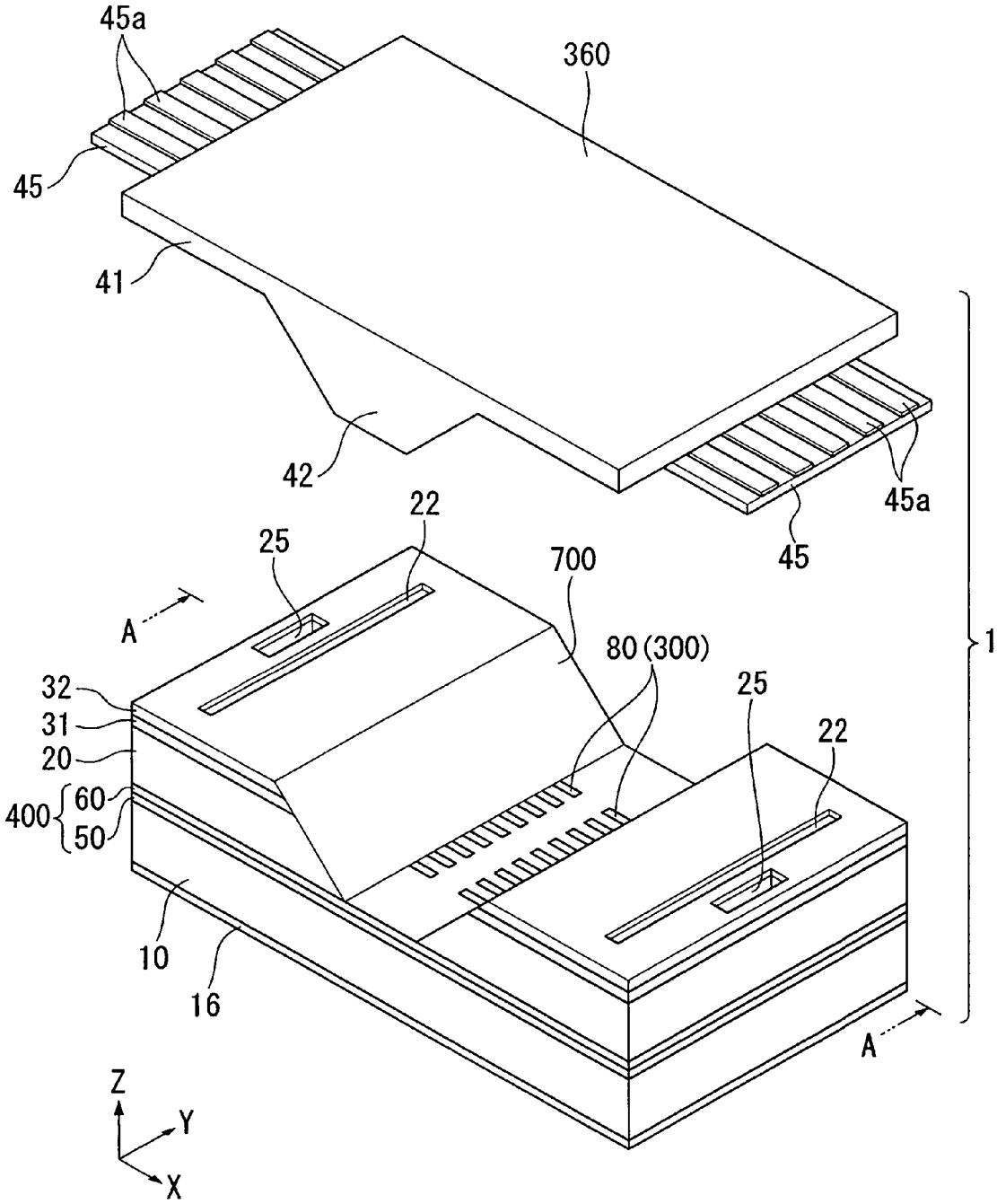
FIG. 1 is a perspective view of a liquid drop ejection head of a first embodiment of the invention.
Figure 2:
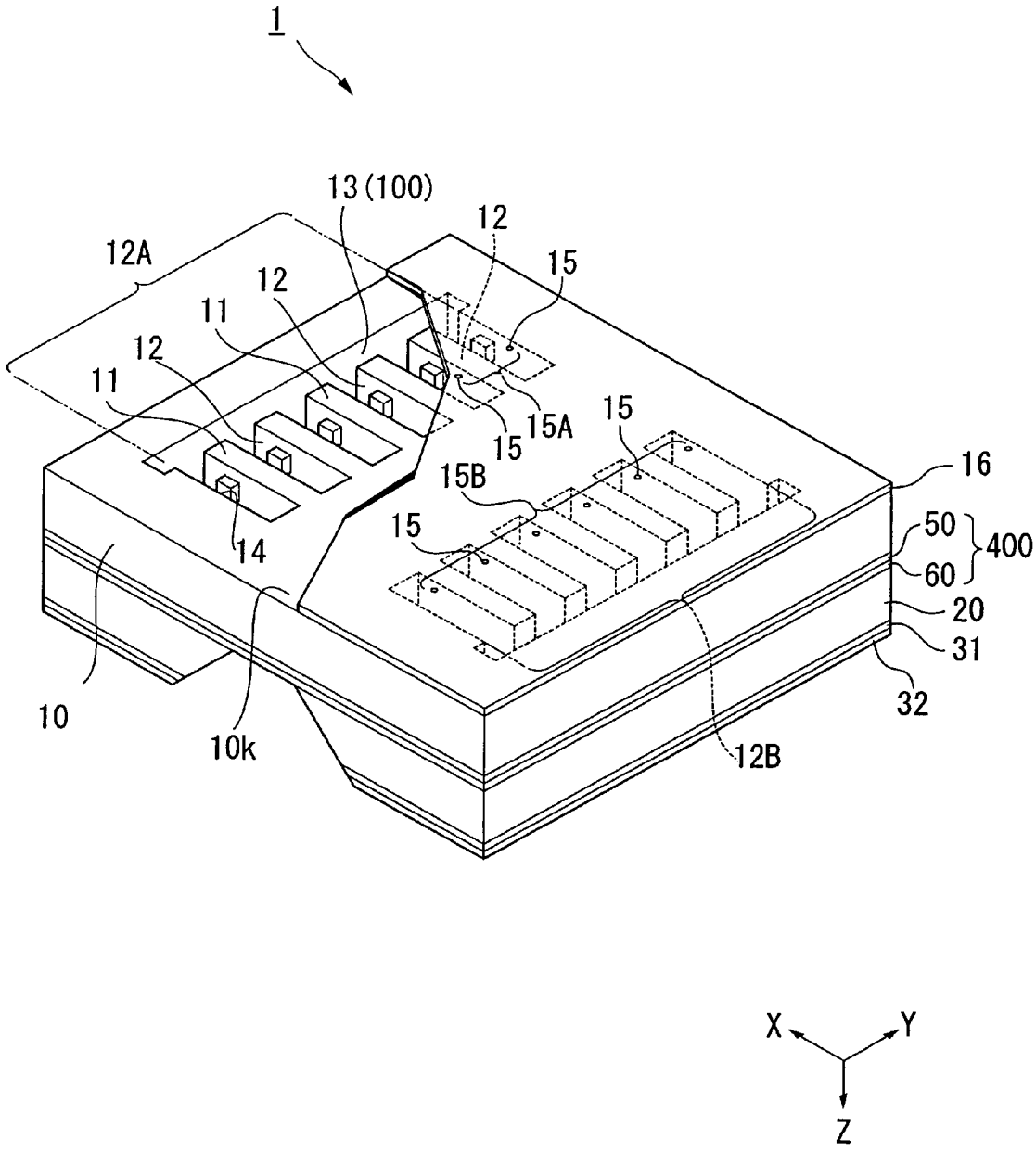
FIG. 2 is a perspective view of a configuration of the liquid drop ejection head, viewed from below.
Figure 3:
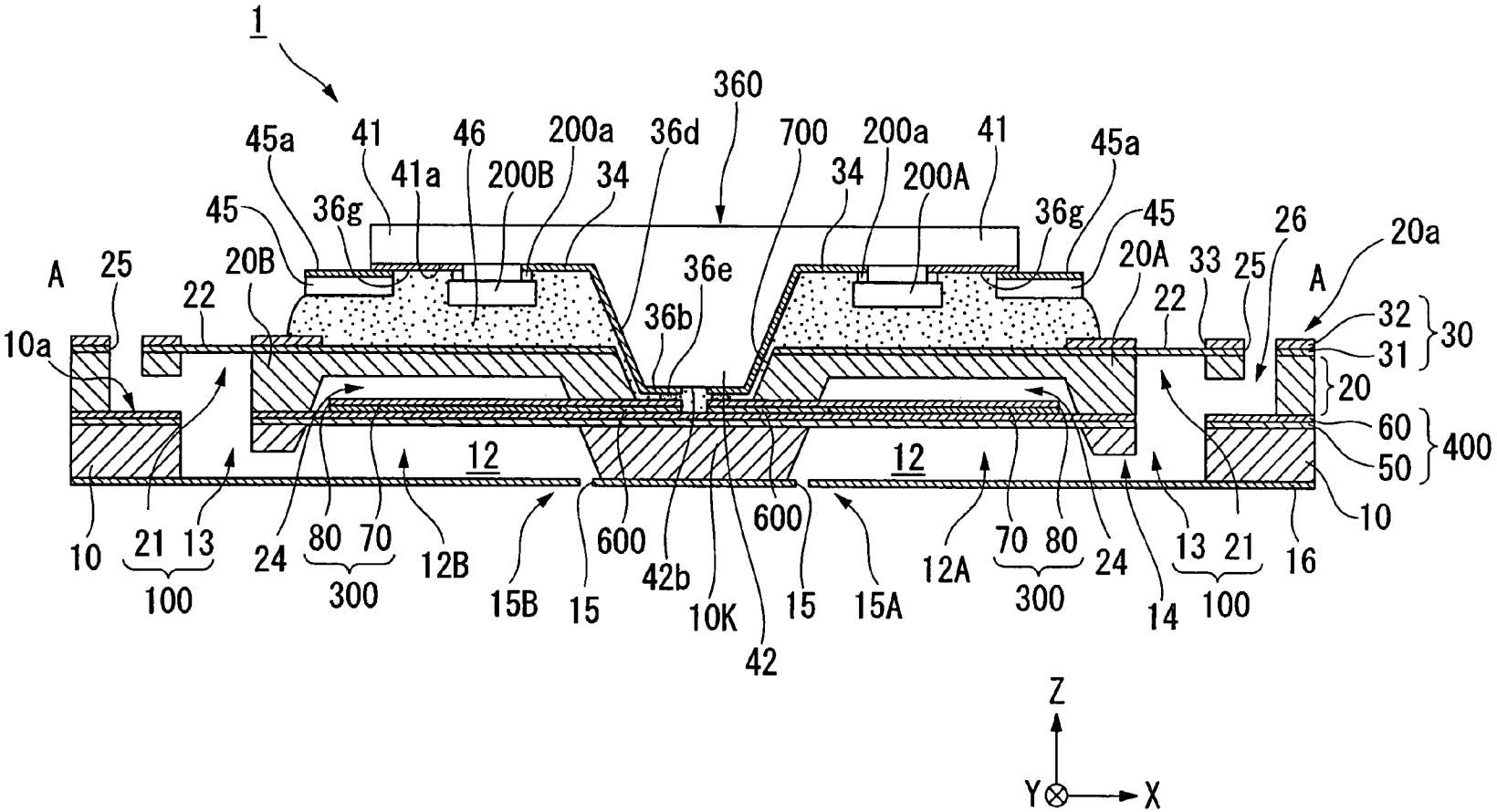
FIG. 3 is a cross-sectional view of the configuration of the liquid drop ejection head, taken along line A-A in FIG. 1.
Figure 4:
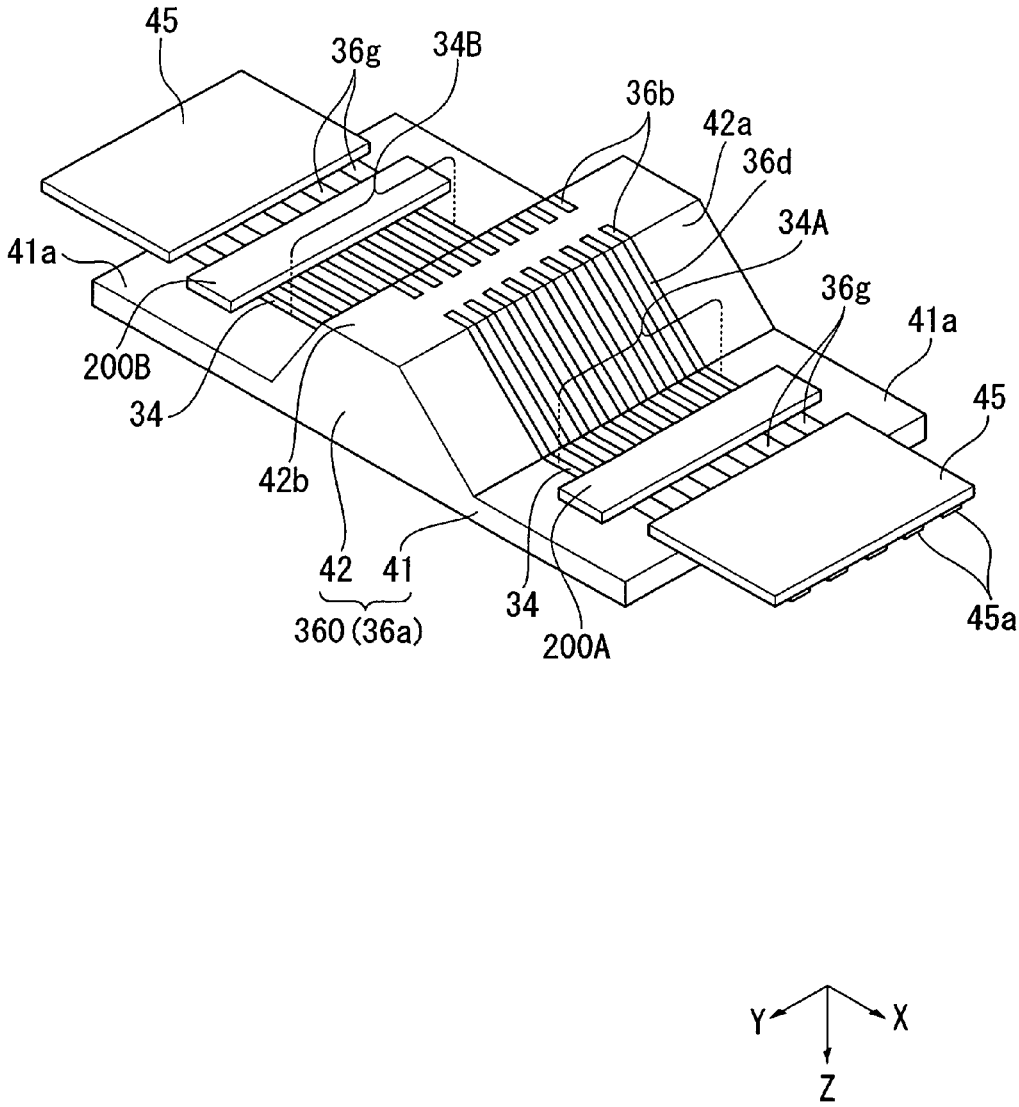
FIG. 4 is a perspective view of a connector.

First, a liquid drop ejection head provided with a device package structure of this invention is explained as a first embodiment of the invention, referring to FIG. 1 through FIG. 4. FIG. 1 is an exploded perspective view showing the first embodiment of a liquid drop ejection head, FIG. 2 is a partial cross-sectional view showing the perspective configuration of a liquid drop ejection head as viewed from below, FIG. 3 is a cross-sectional view along line A-A in FIG. 1, and FIG. 4 is a perspective view of a connector as viewed from the rear side (from below in FIG. 1).

In the following explanations, an XYZ orthogonal coordinate system is used, and the positional relationships of members are explained by reference to this XYZ orthogonal coordinate system. A prescribed direction in the horizontal plane is taken to be the X direction, the direction in the horizontal plane orthogonal to the X direction is the Y direction, and the direction orthogonal to both the X direction and the Y direction (that is, the vertical direction) is the Z direction.

The liquid drop ejection head 1 of this embodiment ejects ink (a functional liquid) in drop form from a nozzle. As shown in FIG. 1 through FIG. 4, the liquid drop ejection head 1 is provided with a nozzle substrate 16 having a nozzle aperture 15 which ejects liquid drops, a flow path formation substrate 10 connected to the upper surface (+Z direction) of the nozzle substrate 16 which forms an ink flow path, a vibration plate 400 connected to the upper surface of the flow path formation substrate 10 which is displaced by the driving of a piezoelectric element (driving element) 300, a reservoir formation substrate (protective substrate) 20 connected to the upper surface of the vibration plate 400 which forms a reservoir 100, two driving circuit sections (driver IC, device) 200A and 200B that are provided in the reservoir formation substrate 20 and that drive the piezoelectric element 300, and a connector 360 on which the driving circuit sections 200A and 2001 are packaged. In the above flow path formation substrate 10 and reservoir formation substrate 20, the base body of this invention is formed.

The operation of the liquid drop ejection head 1 is controlled by an external controller, not shown, connected to each of the driving circuit sections 200A and 200B. In the flow path formation substrate 10 shown in FIG. 2, a plurality of planar, substantially comb tooth-shape apertures are formed and demarcated. Among these aperture areas, the portion in a shape extending in the X direction form a pressure generation chamber 12 which is surrounded by the nozzle substrate 16 and vibration plate 400. Of the planar, substantially comb tooth-shaped (fork shaped) aperture areas, the portion formed extending in the Y direction in the figure form a reservoir 100 surrounded by the reservoir formation substrate 10 and flow path formation substrate 10.

As shown in FIG. 2 and FIG. 3, the lower-face side (−Z direction) of the flow path formation substrate 10 in the drawing is open, and the nozzle substrate 16 is connected to the lower face of the flow path formation substrate 10 so as to cover this opening. The lower face of the flow path formation substrate 10 and the nozzle substrate 16 are fixed in place with for example an adhesive and a heat sealing film or the like intervening. A plurality of nozzle apertures 15 which eject liquid drops are formed in the nozzle substrate 16. Specifically, a plurality of nozzle apertures 15, formed in the nozzle substrate 16, is arranged in the Y direction. In this embodiment, a group of nozzle apertures 15 arranged in a plurality of areas on the nozzle substrate 16 is made up of a first nozzle aperture group 15A and a second nozzle aperture group 15B.

The first nozzle aperture group 15A and second nozzle aperture group 15B are arranged so as to be in opposition along the X direction.

In FIG. 2, each of the nozzle aperture groups 15A and 15B is shown as consisting of six nozzle apertures 15. In actuality, each nozzle group consists of a large number of nozzle apertures 15, for example, approximately 720 apertures.

On the inside of the flow path formation substrate 10 are formed a plurality of barriers 11 extending from the center portion in the X direction. In this embodiment, the flow path formation substrate 10 is formed from silicon, and the plurality of barriers 11 are formed by using anisotropic etching to partially remove the silicon single crystal substrate, which is the parent material of the flow path formation substrate 10. This single crystal silicon can be either cut with a 100 plane crystal orientation and a tapered cross-section, or with a 100 plane crystal orientation with a rectangular cross-section.

The plurality of spaces demarcated by the flow path formation substrate 10 having the plurality of barriers 11, the nozzle substrate 16, and the vibration plate 400, are pressure generation chambers 12.

The plurality of pressure generation chambers 12 are positioned to correspond to the plurality of nozzle apertures 15. That is, the pressure generation chambers 12 are formed to be arranged along the Y direction, so as to correspond to the plurality of nozzle apertures 15 making up the first and second nozzle aperture groups 15A and 15B. The plurality of pressure generation chambers 12 formed to correspond to the first nozzle aperture group 15A make up a first pressure generation chamber group 12A, the plurality of pressure generation chambers 12 formed to correspond to the second nozzle aperture group 15B make up the second pressure generation chamber group 12B.

The first pressure generation chamber group 12A and second pressure generation chamber group 12B are positioned so as to be opposed along the X direction, and a barrier 10K is formed therebetween.

The ends on the substrate center side (−X side) of the plurality of pressure generation chambers 12 which form the first pressure generation chamber group 12A is blocked by the above-described barrier 10K, but the ends on the substrate outer-edge side (+X side) are gathered so as to be joined together, and are connected to the reservoir 100. The reservoir 100 temporarily holds the functional liquid between the functional liquid intake 25 shown in FIG. 1 and FIG. 3, and the pressure generation chambers 12. The reservoir 100 consists of a reservoir portion 21, formed in a plane-view rectangular shape extending in the Y direction in the reservoir formation substrate 20, and a communicating portion 13, formed in a plane-view rectangular shape extending in the Y direction of the flow path formation substrate 10. In the communicating portion 13, a functional liquid holding chamber (ink chamber) is formed, connected to each of the pressure generation chambers 12, and common to the plurality of pressure generation chambers 12 of the first pressure chamber generation group 12A. To review the functional liquid flow path shown in FIG. 3, functional liquid introduced from the functional liquid intake 25 which is open on the upper surface of the head outer edge on the outside of the connector 360, flows into the reservoir 100 via the guidance path 26, passes through the supply path 14, and is supplied to each of the plurality of pressure generation chambers 12 of the first pressure generation chamber group 12A.

A reservoir 100 configured similarly to that described above is connected to each of the pressure generation chambers 12 of the second pressure generation chamber group 12B, and constitutes a portion for temporary holding of functional liquid to be supplied to the pressure generation chamber group 12B, communicated via respective supply paths 14.

The vibration plate 400 positioned between the flow path formation substrate 10 and the reservoir formation substrate 20 has a structure in which an elastic film 50 and a lower electrode film 60 are laminated in order from the side of the flow path formation substrate 10. The material of the elastic film 50 placed on the side of the flow path formation substrate 10 is, for example, a silicon oxide film 1 to 2 μm thickness, the material of the lower electrode film 60 formed on the elastic film 50 is for example a metal film of thickness approximately 0.2 μm. In this embodiment, the lower electrode film 60 also functions as a common electrode for the plurality of piezoelectric elements 300 placed between the flow path formation substrate 10 and the reservoir formation substrate 20.

The piezoelectric element 300 used to deform the vibration plate 400 has a structure in which a piezoelectric film 70 and an upper electrode film (conductive connection portion) 80 are layered, in order from the side of the lower electrode film 60, formed on the upper surface (+Z side) of the flow path formation substrate 10. The thickness of the piezoelectric film 70 is for example 1 μm, and the thickness of the upper electrode film 80 is for example 0.1 μm.

As the concept of the piezoelectric element 300, in addition to a piezoelectric film 70 and upper electrode film 80, the lower electrode film 60 may also be included. The lower electrode film 60 functions as a portion of the piezoelectric element 300, and also functions as a portion of the vibration plate 400. In this embodiment, a configuration is adopted in which the elastic film 560 and lower electrode film 60 function as a vibration plate 400, but the elastic film 50 may be omitted, in a configuration in which the lower electrode film 60 also acts as the elastic film 50.

A plurality of piezoelectric elements 300 (piezoelectric film 70 and upper electrode film 80) are formed so as to correspond to each of the plurality of nozzle apertures 15 and pressure generation chambers 12. In this embodiment, for convenience, the group of piezoelectric elements 300 provided along the Y direction so as to correspond to the nozzle apertures 15 making up the first nozzle aperture group 15A is called the first piezoelectric element group. Similarly, the group of piezoelectric elements 300 provided along the Y direction so as to correspond to the nozzle apertures 15 making up the second nozzle aperture group 15B is called the second piezoelectric element group.

In the planar area of the flow path formation substrate 10, the first piezoelectric element group and second piezoelectric element group are arranged so as to be in opposition in the X direction.

The reservoir formation substrate 20 is formed so as to cover the area on the vibration plate 400, including the piezoelectric elements 300. A compliance substrate 30, the structure of which is a sealing film 31 laminated with a fixed film 32, is bonded onto the upper surface (the surface on the side opposite the flow path formation substrate 10) of the reservoir formation substrate 20. In this compliance substrate 30, the sealing film 31 placed on the inside is made from a material having flexibility and low rigidity (for example, a polyphenylene sulfide film of thickness approximately 6 μm). The upper portion of the reservoir portion 21 is sealed by the sealing film 31. The fixed film 32 placed on the outside is a plate-shaped member, the material of which is a hard metal or the like (for example, stainless steel of thickness approximately 30 μm).

Normally, when functional liquid is supplied from the functional liquid intake 25 to the reservoir 100, there is for example a flow of functional liquid during driving by the piezoelectric element 300, or a change in pressure within the reservoir 100 due tot ambient heat or other causes. But as explained above, the upper portion of the reservoir 100 has a flexible portion 22 which is sealed only by the sealing film 31, and through bowing and deformation of the flexible portion 22 itself, pressure changes within the reservoir 100 are absorbed. Hence, the interior of the reservoir 100 is always maintained at a constant pressure. In the other portion, sufficient strength is maintained by the fixed plate 32. In addition, a functional liquid intake 25 to supply functional liquid to the reservoir 100 is formed on the compliance substrate 30 on the outside of the reservoir 100, and a guidance path 26 communicating with the functional liquid intake 25 to the side wall of the reservoir 100 is provided in the reservoir formation substrate 20.

It is preferable that the reservoir formation substrate 20, as the member constituting the base body of the liquid drop ejection head 1 together with the flow path formation substrate 10, be a rigid body, and it is still more preferable that a material having substantially the same thermal expansion rate as the flow path formation substrate 10 be used as the material to form the reservoir formation substrate 20. In the case of this embodiment, because the material of the flow path formation substrate 10 is silicon, a substrate of silicon single crystal, which is the same material, is suitable. When using a silicon single crystal substrate, anisotropic etching can be used to easily perform machining with a high degree of precision, and so there is the advantage that the piezoelectric element holding portions and groove portion (depression portion) 700 can easily be formed. In addition, similarly to the flow path formation substrate 10, glass, ceramic, or other materials can also be used to fabricate the reservoir formation substrate 20.

As shown in FIG. 1 and FIG. 3, in the reservoir formation substrate 20, a groove portion (depression portion) 700 is formed, in the center area in the X direction, the width in the X direction of which shrinks in moving to lower cross-sections (−Z direction), and which extends in the Y direction. That is, in the liquid drop ejection head of this embodiment, this groove portion 700 forms a level difference portion which separates the upper electrode film 80 (circuit connection portion) of the piezoelectric element 300 and the connection terminals 200*a* of the driving circuit sections 200A, 200B which are to be connected thereto.

In this embodiment, as shown in FIG. 3, of the reservoir formation substrate 20 demarcated in the X direction by the groove portion 700, the portion which seals the plurality of piezoelectric elements 300 connected to the driving circuit section 200A is taken to be the first sealing portion 20A, and the portion which seals the plurality of piezoelectric elements 300 connected to the driving circuit section 200B is taken to be the first sealing portion 20B. In these first sealing portion 20A and second sealing portion 20B are secured a space sufficiently large that the motion (driving) of the piezoelectric element 300 is not impeded, and thereupon is provided a piezoelectric element holding portion (element holding portion) 24 which tightly seals the space. Of the piezoelectric elements 300, at least the piezoelectric film 70 is tightly sealed within this piezoelectric element holding portion 24.

In the case of this embodiment, the piezoelectric element holding portions 24 provided on each of the first and second sealing portions are of dimensions enabling sealing of all piezoelectric elements 300 contained in each piezoelectric element group, and form a depression portion, rectangular in plane view, extending in the direction perpendicular to the plane of the paper in FIG. 3. The piezoelectric element holding portions may be demarcated for each of the piezoelectric elements 300.

As shown in FIG. 3, of the piezoelectric elements 300 sealed by the piezoelectric element holding portions 24 of the first sealing portion 20A, the −X side end of the upper electrode film 80 extends to the outside of the first sealing portion 20A, and is exposed in the bottom portion of the groove portion 700. When a portion of the lower electrode film 60 is positioned on the flow path formation substrate 10 in the groove portion 700, an insulating film 600 is inserted between the upper electrode film 80 and the lower electrode film 60, in order to prevent short-circuits between the upper electrode film 80 and lower electrode film 60. Similarly, of the piezoelectric elements 300 sealed by the piezoelectric element holding portions 24 of the second sealing portion 20B, the +X side end of the upper electrode film 80 extends to the outside of the second sealing portion 20B, and is exposed in the bottom portion of the groove portion 700, at this exposed end also, an insulating film 600 is inserted between the upper electrode film 80 and the lower electrode film 60.

Then, the protruding portion 42 of the connector 360 having the driving circuit sections 200A and 200B is inserted into the groove portion 700, positioned according to the upper electrode film 80 of each of the piezoelectric elements 300, exposed on the bottom surface thereof. In the liquid drop ejection head 1 of this embodiment, by this connector 360, the level difference portion between the bottom portion (upper surface 10A of the flow path formation substrate 10) in the groove portion 700 and the driving circuit sections 200A and 200B is eliminated, and the driving circuit sections 200A and 200B are electrically connected to the piezoelectric elements 300 (upper electrode film 80).

The connector 360 is provided with a flat plate portion (plate portion) 41 of rectangular plate shape, and a connector base member 36*a*, including a protruding portion 42 which protrudes from the flat plate portion 41, as shown in FIG. 4. Here, the protruding portion 42 is shaped so as to protrude toward the −Z direction on the upper surface (first surface) 41*a* of the flat plate portion 41, with the width in the X direction shrinking in moving toward the −Z direction. As a result, the protruding portion 42 has an inclined surface 42*a*, inclined at an obtuse angle from the upper surface 41*a* of the flat plate portion 41, and a tip surface (second surface) 42*b*, parallel to the upper surface 41*a* of the flat plate portion 41 and formed at the tip of the flat plate portion 41. In the upper surface 41*a* of the flat plate portion 41, the driving circuit sections 200A and 200B are packaged on either side of the protruding portion 42, so as to enclose on two sides the protruding portion 42.

The connector 360 is provided with a plurality of terminal electrodes 36*b*, formed in an arrangement on the tip surface 42*b* of the protruding portion 42, a plurality of wiring patterns 34, formed in an arrangement on the upper surface 41*a* of the flat plate portion 41, a plurality of connection wirings 36*d*, which electrically connect each of the terminal electrodes 36*b* formed on the inclined surfaces 42*a* (+X side surface, X side surface) of the protruding portion 42 to the wiring patterns 34 corresponding to the terminal electrodes 36*b*, and bumps (conductive protuberances) 36*e* (not shown in FIG. 4, see FIG. 3), provided to protrude from the terminal electrodes 36*b*.

The driving circuit sections 200A and 200B are configured to contain a semiconductor integrated circuit (IC) containing, for example, a circuit substrate or driving circuit, and are provided with a plurality of connection terminals 200*a* on the lower-surface side in FIG. 4 (the upper-surface side in FIG. 3), these connection terminals 200*a* are connected to the wiring patterns 34 formed on the upper surface 41*a* of the flat plate portion 41.

The driving circuit section 200A is positioned lengthwise along the Y direction on the upper surface 41*a* (on the connector 360) of the flat plate portion 41, the driving circuit section 200B is positioned lengthwise along the Y direction, substantially parallel to the driving circuit section 200A.

In this embodiment, a first wiring group 34A is made up of the group of wiring patterns 34 electrically connected to the piezoelectric elements 300 of the first piezoelectric element group corresponding to the first nozzle aperture group 15A, and a second wiring group 34B is made up of the group of wiring patterns 34 electrically connected to the piezoelectric elements 300 of the second piezoelectric element group corresponding to the second nozzle aperture group 15B.

The wiring patterns 34 in the group making up the first wiring group 34A are connected to the driving circuit section 200A, and the wiring patterns 34 in the group making up the second wiring group 34B are connected to the driving circuit section 200B. In the liquid drop ejection head 1 of this embodiment, a configuration is adopted in which the first piezoelectric element group and second piezoelectric element group, corresponding respectively to the first nozzle aperture group 15A and second nozzle aperture group 15B, are driven by the different driving circuit sections 200A and 200B respectively.

On the flat plate portion 41 are formed a plurality of wiring terminals 36*g*, connected to the driving circuit sections 200A and 200B, extending in the X direction. The plurality of wiring terminals 36*g* are formed on the side opposite the wiring patterns 34, as viewed from the extended X direction. The tips of these wiring terminals 36*g* are connected to lead terminals 45*a* (see FIG. 1). Here, the lead terminals are formed on the +Z direction surface of an external substrate such as a flexible substrate (FPC substrate or the like) 45, connected to an external controller or the like.

As shown in FIG. 3, the X-direction width of the tip surface 42*b* of the protruding portion 42 is greater than the X-direction width of the bottom of the groove portion 700 of the reservoir formation substrate 20. Consequently, when the protruding portion 42 is inserted into the groove portion 700, the side walls of the groove portion 700 and the inclined surfaces 42*a* of the protruding portion 42 are prevented from making contact. Furthermore, the height from the upper surface 41*a* of the plate portion 41 to the tip surface 42*b* of the protruding portion 42 is greater than a depth of the groove portion 700 (the depth from the surface of the fixed plate 32 to the bottom of the groove portion 700). More specifically, the size is set such that even when the protruding portion 42 is inserted into the groove portion 700, the driving circuit sections 200A and 200B packaged on the upper surface 41*a* (the lower-side surface in FIG. 3) of the flat plate portion 41 do not make contact with the (upper surface 20*a* of the) reservoir formation substrate 20.

Furthermore, in the connector 360, a single connector terminal is formed by a terminal electrode 36*b*, a wiring pattern 34, connection wiring 36*d* connecting these two, and a bump 36*e*. Such connector terminals are formed on the connector 360, positioned at a prescribed pitch. This plurality of connector terminals has a pitch which matches the pitch of the plurality of upper electrode film portions 80 formed extending into the groove portion 700 shown in FIG. 3. Because the pitch of the plurality of connector terminals matches the pitch of the plurality of upper electrode film portions 80, simply by inserting the connector 360 into the groove portion 700, each of the plurality of connector terminals can be connected to each of plurality of upper electrode film portions 80 corresponded to the connector terminal.

Of the plurality of connector terminals arranged in the extended direction of the connector 360, groups of connector terminals arranged in proximity form a first connector terminal group and a second connector terminal group. The first connector terminal group and second connector terminal group are arranged in opposition in the X direction of the connector base member 36*a*.

On the connector 360 are formed alignment marks (not shown), at positions on the upper surface 41*a* of the flat plate portion 41. Alignment marks serve as references when detecting the positions of the first connector terminal group and second connector terminal group, and are formed at positions which are precisely positioned with respect to the first connector terminal group and second connector terminal group. These alignment marks are formed using the same materials and the same process as are used to form the terminal electrodes 36*b*, wiring patterns 34, connection wirings 36*d* and bumps 36*e*, so that positional precision relative to the first connector terminal group and second connector terminal group can easily be maintained.

The connector base member 36*a* has an insulating surface. Furthermore, the connector base member 36*a* can use, for example, a ceramic (alumina ceramics or zirconia ceramics), engineering plastics (polycarbonate, a polyimide, a liquid crystal polymer, or the like), a glass epoxy, glass, or another insulating molded body, or a base member of silicon (Si) can be used, with a silicon oxide film formed on the surface by thermal oxidation, or with an insulating resin film formed on the surface of the silicon base member. When using a connector member 36*a* in which an insulating film is formed on the surface of a silicon base member, the linear expansion coefficient is substantially the same as a flow path formation substrate 10 or reservoir formation substrate 20 using silicon material, and the thermal expansion rate can be made the same, so that there is the advantage that separation or the like of conductive joint portions due to changes in volume with temperature changes can be effectively prevented. Hence, in this embodiment, silicon single-crystal substrates (with orientation in the 100 plane direction), formed by partial removal of material using anisotropic etching, are employed.

On the other hand, when using a molded body of glass epoxy, ceramics, engineering plastics or the like as the connector base member 36*a*, shock resistance and similar superior to that when using a silicon base member is obtained.

The terminal electrodes 36*b*, wiring patterns 34, connection wirings 36*d*, bumps 36*e*, and wiring terminals 36*g* which make up the connector terminals can be formed from metal materials, conductive polymers, superconductors, or the like. It is preferable that the material of the connector terminal be Au (gold), Ag (silver), Cu (copper), Al (aluminum), Pd (palladium), Ni (nickel), or another metal material. In particular, it is preferable that the bumps 36*e* on the terminal electrodes 36*b* be formed from Au. This is because when Au bumps are used for the connection terminals 200*a* of the driving circuit sections 200A and 200B, a reliable Au—Au connection can be obtained.

The connector 360 having the above configuration is positioned in the state in which the terminal electrodes 36*b* and bumps 36*e* in the protruding portion 42 are facing the bottom (upper electrode film 80) of the groove portion 700, as shown in FIG. 3. Furthermore, the connector 360 is flip-chip packaged onto the upper electrode film 80 of the piezoelectric elements 300 extending out within the groove portion 700, via the bumps 36*e*. An epoxy resin or other non-conducting resin 46 is placed on the surface (Z direction) on which the driving circuit sections 200A and 200B are packaged, between the connector 360 packaged in the groove 700 and the base body (flow path formation substrate 10 and reservoir formation substrate 20). Such a non-conductive resin 46 is formed by molding (injection molding). In the connector 360, flow path formation substrate 10 and reservoir formation substrate 20 are integrated, to constitute the liquid drop ejection head 1.

Here, this embodiment of the connector 360 is explained in further detail. The first connector terminal group is electrically connected, via the terminal electrodes 36*b* and bumps 36*e*, to the upper electrode film portions 80 of piezoelectric elements 300 making up the first piezoelectric element group corresponding to the first nozzle aperture group 15A and first pressure chamber generation group 12A, among the plurality of upper electrode film portions 80 arranged on the bottom of the groove portion 700. The second connector terminal group is electrically connected, via the terminal electrodes 36*b* and bumps 36*e*, to the upper electrode film portions 80 of piezoelectric elements 300 making up the second piezoelectric element group corresponding to the second nozzle aperture group 15B and second pressure chamber generation group 12B.

In particular, in this embodiment bumps 36*e* of Au are provided on the terminal electrodes 36*b* of the connector 360, so that the bumps 36*e* are easily deformed when pressing the connector 360 against the upper electrode film 80. Hence, even if shifts in the Z-direction position of the terminal electrodes 36*b* occur due to scattering in the height of the connector 360 (flat plate portion 41 and protruding portion 42), the shift can be absorbed through deformation of the bumps 36*e*, and the terminal electrodes 36*b* can be electrically connected to the respective upper electrode film portions 80 with reliability.

In a flip-chip packaging (conductive connection structure) mode, it is possible to use metal crimp contacts, brazing metals, anisotropic conductive film (ACF), anisotropic conductive paste (ACP) and other anisotropic conductive materials, non-conductive film (NCF), non-conductive paste (NCP), and other insulating resin materials.

When performing flip-chip packaging of the driving circuit sections 200A and 200B also, conductive connection structures may be adopted which use the above metal crimp contacts, brazing metals, and anisotropic conductive films, anisotropic conductive pastes, and other anisotropic conductive materials, as well as non-conductive films, non-conductive pastes, and other insulating resin materials.

In order to eject drops of the functional liquid from the liquid drop ejection head 1 configured as described above, an external functional liquid supply device, not shown, connected to the functional liquid intake 25, is driven by an external controller (not shown) connected to the liquid drop ejection head 1. Functional liquid sent from the external functional liquid supply device is supplied to the reservoir 100 via the functional liquid intake 25, after which the flow path within the liquid drop ejection head 1 up to the nozzle apertures 15 is filled.

The external controller transmits driving power and command signals to the driving circuit section 200 packaged on the reservoir formation substrate 20. Upon receiving a command signal and similar, the driving circuit section 200 transmits a driving signal, based on the command from the external controller, to each of the piezoelectric elements 300 electrically connected via the wiring patterns 34 and terminal electrodes of the connector 360.

Then, as a result of application of a voltage across the lower electrode film 60 and upper electrode film 80 corresponding to the respective pressure generation chambers 12, displacement occurs in the elastic film 50, lower electrode film 60 and piezoelectric film 70, and as a result of this displacement the volume of each of the pressure generation chambers 12 changes, the internal pressure rises, and liquid drops are ejected from nozzle apertures 15.

Method of Connector Manufacture

The connector 360 used in the liquid drop ejection head of this embodiment can be fabricated by grinding or other machining when using ceramics, glass epoxy, or another insulating base member, and by forming patterns on the surface of the connector base member 36*a*, formed into the convex shape in cross-section shown in FIG. 3 and FIG. 4, to form the connector terminals (terminal electrodes 36*b*, connection wirings 36*d*, wiring patterns 34, bumps 36*e*) and the wiring terminals 36*g*. When using a base member having conductivity such as a silicon base member, the connector terminals can be fabricated by pattern formation onto the surface of a connector base member obtained by forming a silicon oxide film by thermal oxidation or the like on the surface of a silicon base member formed into a convex shape in cross-section by partial removal of material using anisotropic etching or the like, or onto the surface of a connector base member obtained by forming an insulating silicon film on the surface of the silicon base member.

Specifically, for example resist is placed on the surface (equivalent to the tip surface 42*b*) of single-crystal silicon with a 100 crystal plane orientation, and a KOH solution, ethylene amine solution, or other etching solution is used in anisotropic etching to form the upper surface 41*a* of the flat plate portion 41. After removing the resist, oxide films and metal films are formed, resist is again applied, and photolithography or another technique is used in patterning to form the wiring (connector terminals).

Other methods in addition to this method for forming patterns for connector terminals on the connector base member 36*a* include, for example, the method of using photolithography techniques to pattern a conductive film formed by a vapor phase method, the method of placing a mask member, provided with apertures in a prescribed pattern, over the connector base member 36*a*, and using a vapor phase method or plating method through the mask member to selectively form a conductive film (metal film), the method of using the liquid drop ejection method to form a conductive film pattern, and the method of using a printing method to form a conductive film pattern on the connector base member 36*a*.

Next, as an example of a method of manufacture of the connector 360, a method of formation of the connection terminals (terminal electrodes 36*b*, wiring patterns 34, connection wirings 36*d*, bumps 36*e*) and wiring terminals 36*g* using a liquid drop ejection method is explained. In this embodiment, a case is explained in which a ceramic molded body with a convex shape in cross-section is used as the connector base member 36*a*, but the method is similar when using a connector base member of another material.

In formation of connector terminals using the liquid drop ejection method, a liquid drop ejection apparatus having the liquid drop ejection head 1 is suitable for use. That is, the apparatus is placed such that ink used to form the connector terminals is ejected from the liquid drop ejection head 1 provided in the liquid drop ejection apparatus, to form the prescribed pattern on the connector base member 36*a*. Thereafter, the ink on the connector base member 36*a* is dried and baked, to form a metal thin film. By repeating the above process, in order, for the tip surface 42*b* and inclined surfaces 42*a* of the protruding portion 42 and for the upper surface 41*a* of the flat plate portion 41, the terminal electrodes 36*b* and wiring patterns 34, as well as the connection wirings 36*d*, bumps 36*e*, and wiring terminals 36*g* connected thereto can be formed on the connector base member 36*a*.

Ink

When forming connector terminals using a liquid drop ejection apparatus, the ink (functional liquid) ejected from the liquid drop ejection head is a liquid containing fine conductive particles (the pattern formation component). As the liquid containing fine conductive particles, a disperse liquid in which fine conductive particles are dispersed in a dispersing medium is employed. As the minute conductive particles used here, fine metal particles containing Au, Ag, Cu, Pd, Ni or the like, fine particles of a conductive polymer or of a superconductor can also be used.

In order to enhance the dispersing properties in ink, the surface of the fine conductive particles can be coated with an organic material or the like. As the coating material used to coat the surface of the fine conductive particles, for example, xylene, toluene, or another organic solvent, as well as citric acid and similar can be used. It is preferable that the diameters of the fine conductive particles be 5 nm or greater and 0.1 μm or less. If particles are greater than 0.1 μm, clogging of nozzles tends to occur, and ink ejection using the liquid drop ejection method becomes difficult. If particles are less than 5 nm, the volume ratio of the coating material relative to the fine conductive particles is increased, and the fraction of organic material in the resulting film becomes excessive.

As the dispersing medium of the ink containing fine conductive particles, it is preferable that the vapor pressure at room temperature be 0.001 mmHg or higher, and 200 mmHg or lower (approximately 0.133 Pa or higher and 26600 Pa or lower). If the vapor pressure is higher than 200 mmHg, the dispersing medium evaporates violently after ejection, and it is difficult to obtain a good-quality film.

It is more preferable still that the vapor pressure of the dispersing medium be 0.001 mmHg or higher and 50 mmHg or lower (approximately 0.133 Pa or higher and 6650 Pa or lower). If the vapor pressure is higher than 50 mmHg, drying at the time of ejection of liquid drops in the liquid drop ejection method tends to cause clogging of the nozzles, and stable ejection becomes difficult. On the other hand, in the case of a dispersing medium with a room temperature vapor pressure lower than 0.001 mmHg, drying requires time, the dispersing medium tends to remain in the film, and a good-quality conductive film cannot easily be obtained after the subsequent heat and/or irradiation treatment.

As the dispersing medium used, any medium which can disperse the above-described fine conductive particles and does not coagulate may be used, in addition to water, examples include methanol, ethanol, propanol, butanol, and other alcohols, n-heptane, n-octane, decane, toluene, xylene, cymene, durene, indene, tetrahydronaphthalene, decahydronaphthalene, cyclohexylbenzene, and other hydrocarbon compounds, ethylene glycol dimethyl ether, ethylene glycol diethyl ether, ethylene glycol methylethyl ether, ethylene glycol dimethyl ether, diethylene glycol diethyl ether, diethylene glycol methylethyl ether, 1,2-dimetoxyethane, bis-(2-methoxyethyl)ether, p-dioxane, and other ether-based compounds, and also propylene carbonate, γ-butyrolactone, N-methyl-2-pyrolidone, dimethylformamide, dimethyl sulfoxide, cyclohexanone, and other polar compounds.

When forming the connector terminals shown in FIG. 4 from a metal thin film, for example, a fine metal particle disperse liquid, in which fine gold particles of diameter approximately 10 nm are dispersed in toluene, is further diluted with toluene, adjusted such that the viscosity is approximately 5 mPa·s and the surface tension is approximately 20 mN/m, this liquid is then used as the ink in forming the terminal electrodes 36*b*, 36*c* and the connection wiring 36*d* and bumps 36*e*.

Procedure for Formation of Connector Terminals

Upon preparing the above-described ink, a process is performed in which liquid drops of the ink are ejected from the liquid drop ejection head 1 onto the connector base member 36*a*.

In advance of the liquid drop ejection process, the connector base member 36*a* may be subjected to surface treatment. That is, the surface for ink application of the connector base member 36*a* may be subjected to ink repellency treatment (liquid repellency treatment) prior to ink application. By performing such ink repellency treatment, the position of the ink ejected onto (applied to) the connector base member 36*a* can be controlled more precisely.

If this ink repellency treatment is performed as necessary on the surface of the connector base member 36*a*, drops of ink can be ejected from the liquid drop ejection head 1 and applied to prescribed positions on the connector base member 36*a*. In this process, liquid drops are ejected while the liquid drop ejection head 1 is scanned over the connector base member 36*a*, so that a plurality of ink patterns (for example, an ink pattern which is to become a terminal electrode 36*b*) are formed on the surface on one side of the connector base member 36*a*.

At this time, when liquid drops are ejected continuously to form a pattern, it is preferable that the extent of overlap of liquid drops be controlled such that liquid accumulations (bulges) do not occur. In this case, if an ejection placement method is adopted in which a plurality of liquid drops are ejected in one action and placed so as to be distant from each other and not make contact, and then, in a second action and subsequent actions, the intervals between the drops are filled, then bulges can be prevented satisfactorily.

Once liquid drops have been ejected to form a prescribed ink pattern on the connector base member 36*a*, drying treatment is then performed as necessary to remove the dispersing medium from the ink. In drying treatment, for example treatment can be performed using an ordinary hot plate or electric furnace to heat the base member, or lamp annealing can be performed. No particular constraints are placed on the light source used in lamp annealing, but infrared lamps, xenon lamps, YAG lasers, argon lasers, carbon dioxide lasers, and XeF, XeCl, XeBr, KrF, KrCl, ArF, ArCl, and other excimer lasers, or other light sources can be used.

Next, the dried film obtained by drying the ink pattern is subjected to baking treatment to obtain satisfactory electrical contact between the fine particles. In this baking treatment the dispersing medium is completely removed from the dried film, and when the surfaces of the fine conductive particles have been coated with an organic coating to improve dispersive properties, this coating is also removed.

Baking treatment is performed by heat treatment or light treatment, or by combining the two. Baking treatment is normally performed in air, but can also be performed in nitrogen, argon, helium, or other inert gas atmosphere as necessary. The treatment temperature in baking treatment can be determined as appropriate taking into account the boiling point (vapor pressure) of the dispersing medium, the type and pressure of the atmosphere gas, the dispersive properties, oxidation properties and other thermal behavior of the fine particles, the presence and amount of a coating material, the heat resistance of the base member, and similar. For example, in order to remove an organic coating material, baking at approximately 300° C. is necessary. In addition, when using substrates of plastic or a similar material, it is preferable that baking be performed at room temperature or higher, but at 100° C. or lower.

In the above process, electrical contact between fine particles in the film is secured, and the film is converted into a conductive film.

Thereafter, the above liquid drop ejection process, drying process, and baking process are performed on the surfaces on each side of the connector base member 36*a*, to manufacture a connector 360 in which a plurality of connector terminals are formed on a connector base member 36*a*.

It is also possible to perform the liquid drop ejection process and drying process for each surface of the connector base member 36*a*, to form a dried film in a prescribed pattern on the surfaces on each side of the connector base member 36*a*, and then finally perform the baking process all at once, to convert the dried film into a conductive film. Because in the dried film there are numerous gaps between the fine conductive particles making up the film, when ink is placed on top of the film, the ink can be held satisfactorily. Hence, by performing the liquid drop ejection process on other surfaces in a state in which a dried film has been formed on one surface of the connector base member 36*a*, the connectivity of the dried film formed on the surfaces on each side can be improved. That is, the connectivity of the connection portions between the terminal electrodes 36*b* and the connection wirings 36*d*, and of the connection portions between the wiring patterns 34 and the connection wirings 36*d*, can be improved, and connector terminals with superior reliability can be formed.

Method of Manufacture of a Liquid Drop Ejection Head

Figure 5:
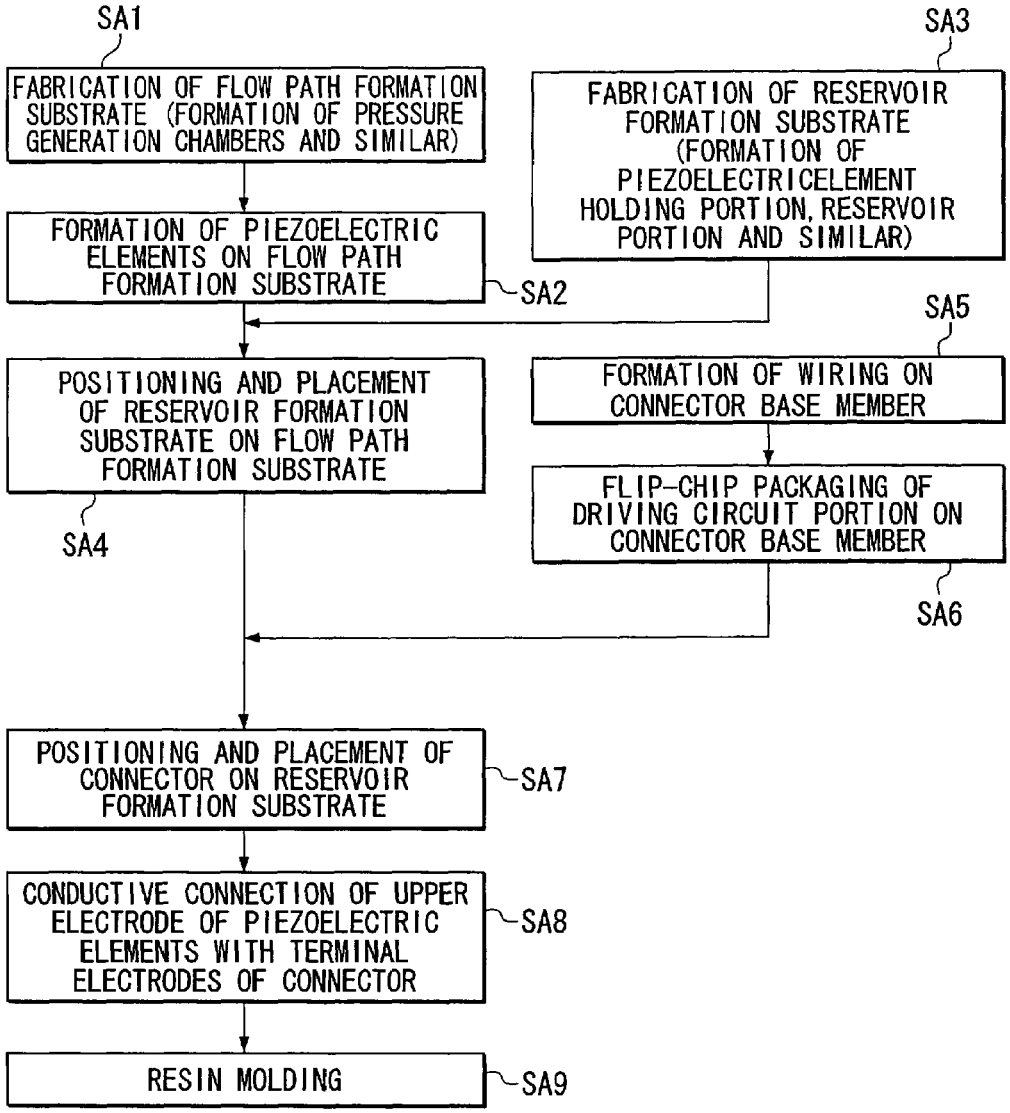
FIG. 5 is a view of flowchart showing a method of manufacture of a liquid drop ejection head.

Next, a method of manufacture of the liquid drop ejection head 1 is explained, referring to the flowchart of FIG. 5.

In order to manufacture the liquid drop ejection head 1, for example a silicon single-crystal substrate is subjected to anisotropic etching and dry etching to form the pressure generation chambers 12, supply paths 14, communicating portions 13 and similar shown in FIG. 3, in order to fabricate a flow path formation substrate 10 (step SA1). Then, an elastic film 50 and lower electrode film 60 are layered on the flow path formation substrate 10, following which a piezoelectric film 70 and upper electrode film 80 are formed by patterning on the lower electrode film 60, to form piezoelectric elements 300 (step SA2).

In a process separate from the processes of steps SA1 and SA2, by subjecting a silicon single-crystal substrate to anisotropic etching and dry etching, a piezoelectric element holding portion 24 and groove portion 700, as well as a guidance path 26 are formed and dry etching is used to form the reservoir portion 21, to fabricate a reservoir formation substrate 20 (step SA3). Next, a compliance substrate 30 is bonded to the top of the reservoir formation substrate 20.

Next, the reservoir formation substrate 20 formed in step SA3 is positioned, at a position which covers the piezoelectric elements 300, on the flow path formation substrate 10 formed in step SA2 (step SA4). Then, the flow path formation substrate 10 and the reservoir formation substrate 20 are bonded together. In a process separate from those of steps SA1 to SA4, the terminal electrodes 36*b*, wiring patterns 34, and the connection wirings 36*d*, bumps 36*e* and wiring terminals 36*g* and similar connecting these, are formed on the connector base member 36*a* as described above (step SA5).

Next, the connector 360 is formed by using the above-described flip-chip packaging to package the external substrate 45 and driving circuit sections 200A and 200B on prescribed areas (packaging areas) on the connector base member 36*a* (step SA6). Here, the external substrate 45 is connected to the connector 360.

It is preferable that the processes of formation of a flow path formation F substrate 10, reservoir formation substrate 20 and connector 360 each be performed to form a plurality of such components on a wafer, and that the wafer then be divided for use. Hence, it is possible to improve production efficiency.

Then, the connector 360 formed in step SA6 is positioned on the reservoir formation substrate 20 (step SA7), the protruding portion 42 is inserted into the groove portion 700, and the terminal electrodes 36*b* (bumps 36*e*) are electrically connected with the upper electrode film portions 80 (circuit connection portions) of the piezoelectric elements 300 (step SA8). Connections at this time employ flip-chip packaging using metal crimp contacts, brazing metals, anisotropic conductive film and anisotropic conductive past and other anisotropic conductive materials, non-conductive film, non-conductive past and other insulating resin materials for heating, pressurizing and ultrasonic vibration. When employing an ultrasonic heating method, in order that the vibrations applied to the connector 360 do not adversely affect the precision of connections between terminal electrodes 36*b* arranged in the Y direction and the upper electrode film 80, it is preferable that vibrations be applied in the X direction, orthogonal to (perpendicular to) the direction of arrangement.

When inserting the protruding portion 42 of the connector 360 into the groove portion 700, by measuring the alignment marks formed in the connector 360, positioning with respect to the reservoir formation substrate 20 is made easy, and can be performed precisely.

Next, a non-conductive resin 46 is used to seal the connector 360 and reservoir formation substrate 20 by resin molding (step SA9).

In the above processes, a liquid drop ejection head 1 can be manufactured.

As explained above, in this embodiment, by placing the protruding portion 42 of a connector 360 in the groove portion 700 in which is provided a reservoir formation substrate 20, even when a depression or other level difference portion is formed in the surface of the reservoir formation substrate 20, the connection wiring portions (upper electrode film 80) of the piezoelectric elements 300 and the connection terminals 200*a* of the driving circuit sections 200A to 200B can be electrically connected. The space required to draw out wires such as needed in structures in which driving circuit sections are connected to piezoelectric elements by wire bonding, is unnecessary, and it is possible to achieve the liquid drop ejection head 1 be thin. Furthermore, the groove portion 700 is filled by the connector 360, and the connector 360 and reservoir formation substrate 20 are sealed and integrated by resin 46, so that the rigidity of the liquid drop ejection head 1 itself can be increased, and declines in the ejection precision due to warping and similar can be effectively prevented, while also suppressing moisture absorption and improving the reliability of connections.

In this embodiment, even when the pitch between nozzle apertures 15 is decreased and the pitch between piezoelectric elements 300 is correspondingly narrowed, so that wire bonding becomes extremely difficult, the driving circuit sections 200A and 200B can easily be electrically connected to the piezoelectric elements 300. That is, it is possible to form the connector terminals of the connector 360 at precise positions and with precise dimensions, so that even when the pitch between nozzle apertures 15 is reduced, it is possible to manufacture a device in which the piezoelectric elements 300 arranged at a small pitch are positioned precisely. Hence, in this embodiment, a liquid drop ejection head 1 is obtained which is capable of finely detailed image formation and functional film pattern formation.

In addition, in this embodiment, connection of the piezoelectric elements 300 and the driving circuit sections 200A and 200B is possible through a single connection of the terminal electrodes 36*b* (bumps 36*e*) and the upper electrode film portions 80 (circuit connection portions), so that there is the advantageous result that manufacturing efficiency is improved.

Furthermore, in this embodiment the connector terminals (terminal electrodes 36*b*, wiring patterns 34 and connection wirings 36*d* connected thereto, bumps 36*e*, and wiring terminals 36*g*) are formed on the same side of the connector base member 36*a*, so that the connector 360 can be manufactured efficiently.

Furthermore, in this embodiment the connector 360 has inclined surfaces 42*a*, so that there is guidance upon insertion into the groove portion 700, and the task of connection can be performed reliably. Furthermore, because the width of the tip surface 42*b* of the protruding portion 42 having inclined surfaces 42*a* is smaller than the width of the bottom of the groove portion 700, a short-circuit between terminals resulting from contact of the wiring patterns 34 with the connector 360 can be prevented. Furthermore, in this embodiment the angle made by the tip surface 42*b* and the inclined surfaces 42*a* of the protruding portion 42 on which the terminal electrodes 36*b* are formed is obtuse, and the angle made by the upper surface 41 a of the flat plate portion 41 and the inclined surfaces 42*a* is obtuse, so that the concentration of stress acting on the connection wiring formed on the inclined surface can be relaxed, and broken wires and other problems can be avoided. In addition, it is easier to fabricate a connection wiring film on the inclined surfaces 42*a* compared with a case in which the angle between the tip surface 42*b* and the inclined surfaces 42*a*, and the angle between the upper surface 41*a* and the inclined surfaces 42*a*, is a right angle.

In this embodiment, bumps 36*e* are formed on the connector 360, and the upper electrode film portions 80 and terminal electrodes 36*b* are connected via the bumps 36*e*, so that when pressing on the connector 360 the bumps 36*e* can easily be deformed. Hence, even when there is scattering in the height of the connector 360 (the tip surface 42*b* of the protruding portion 42) so that the position of the terminal electrodes 36*b* in the Z direction is shifted, this shift can be absorbed through deformation of the bumps 36*e*, and the terminal electrodes 36*b* and upper electrode film portions 80 can be electrically connected with good reliability. In addition, in this embodiment the linear expansion coefficients are the same for the base member 36*a* of the connector 360, the flow path formation substrate 10, and the reservoir formation substrate 20, so that there is the advantage that separation of conductive joint portions due to changes in volume with temperature changes can be effectively prevented.

In this embodiment, flip-chip packaging is used for the driving circuit sections 200A and 200B and the connector 360 (protruding portion 42). Hence, the same equipment (packaging equipment) can be used to package these components together, contributing to improved production efficiency.

In addition, in this embodiment an external substrate 34 is connected to the connector 360 with the lead terminals 45*a* in the +Z direction (that is, open on the side opposite the liquid drop ejection head 1), so that the task of connection to external equipment is made easy, further contributing to improved production efficiency.

In the liquid drop ejection head 1 of this embodiment, the piezoelectric elements 300 are sealed with resin between the connector 360 and the reservoir formation substrate 20, to shut out the external environment, so that degradation of characteristics of the piezoelectric elements 300 due to water and other factors of the external environment can be prevented. Also, in this embodiment the interior of the piezoelectric element holding portion 24 was merely put into a tightly sealed state, however, by evacuating the space in the piezoelectric element holding portion 24, or by injecting a nitrogen or argon atmosphere, the interior of the piezoelectric element holding portion 24 can be maintained at low humidity, and in the such a configuration, degradation of the piezoelectric elements 300 can be effectively prevented.

Second Embodiment

Figure 6:
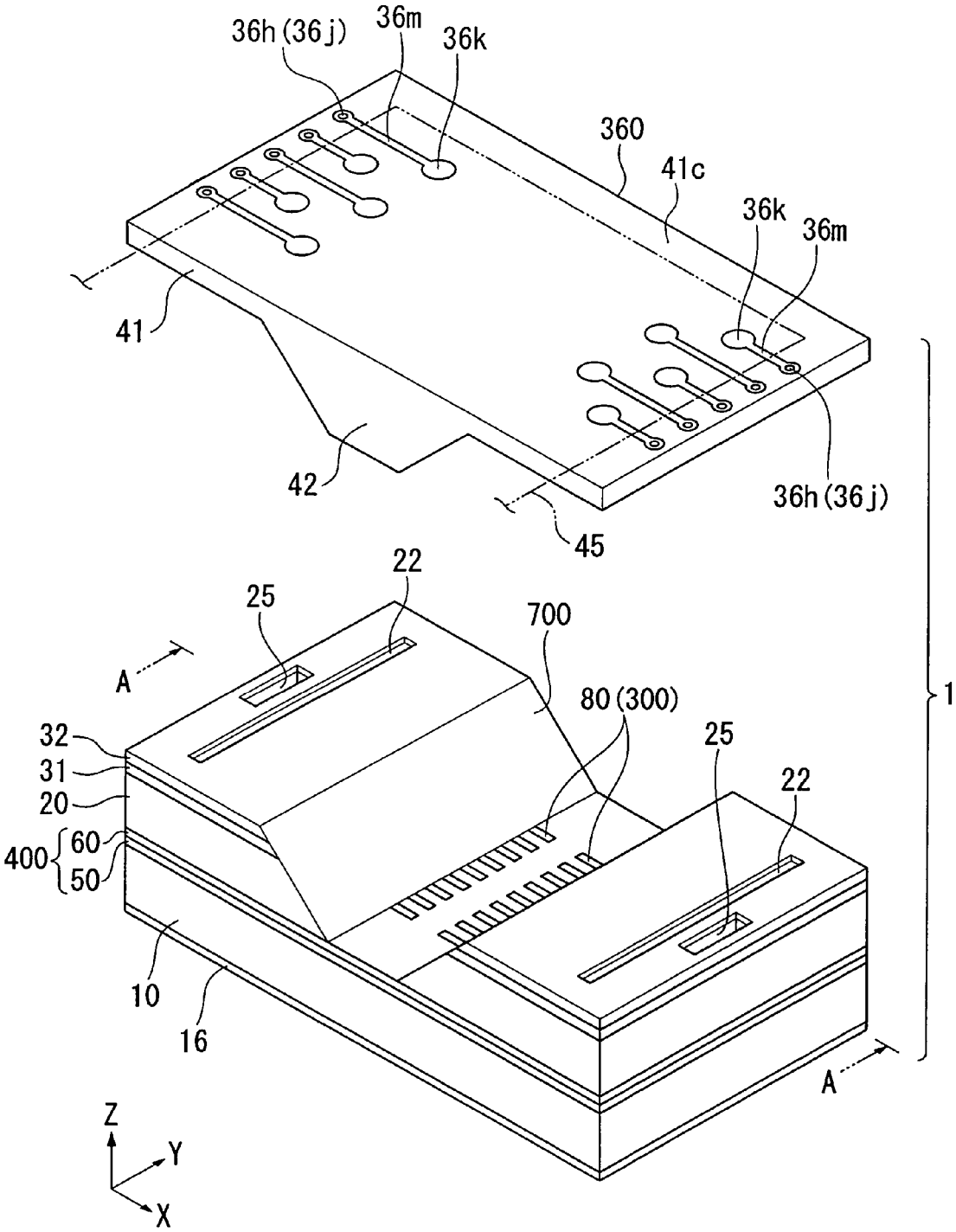
FIG. 6 is a perspective view of a liquid drop ejection head-of a second embodiment of the invention.
Figure 7:
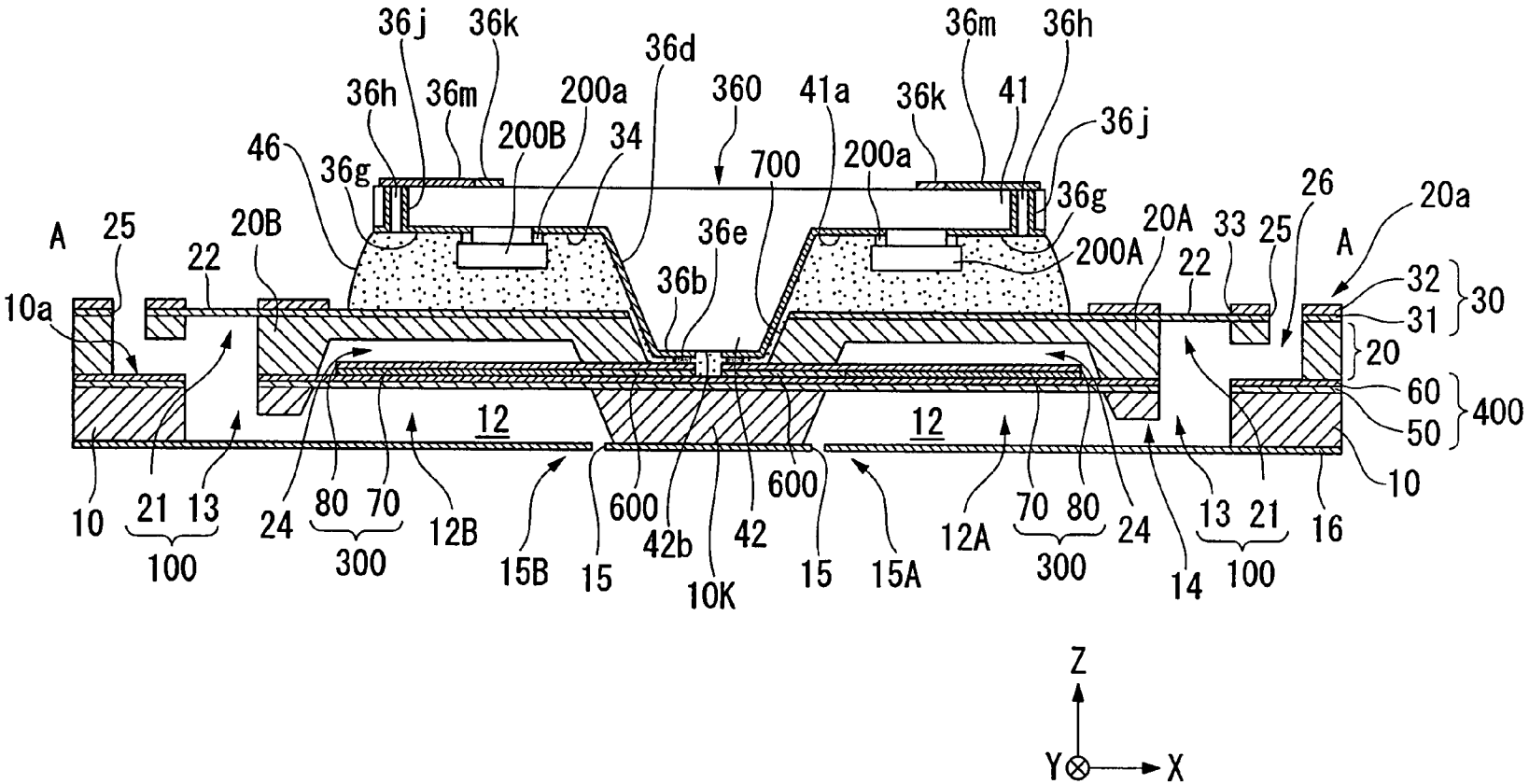
FIG. 7 is a cross-sectional view of the configuration of the liquid drop ejection head, taken along line A-A in FIG. 6.
Figure 8:
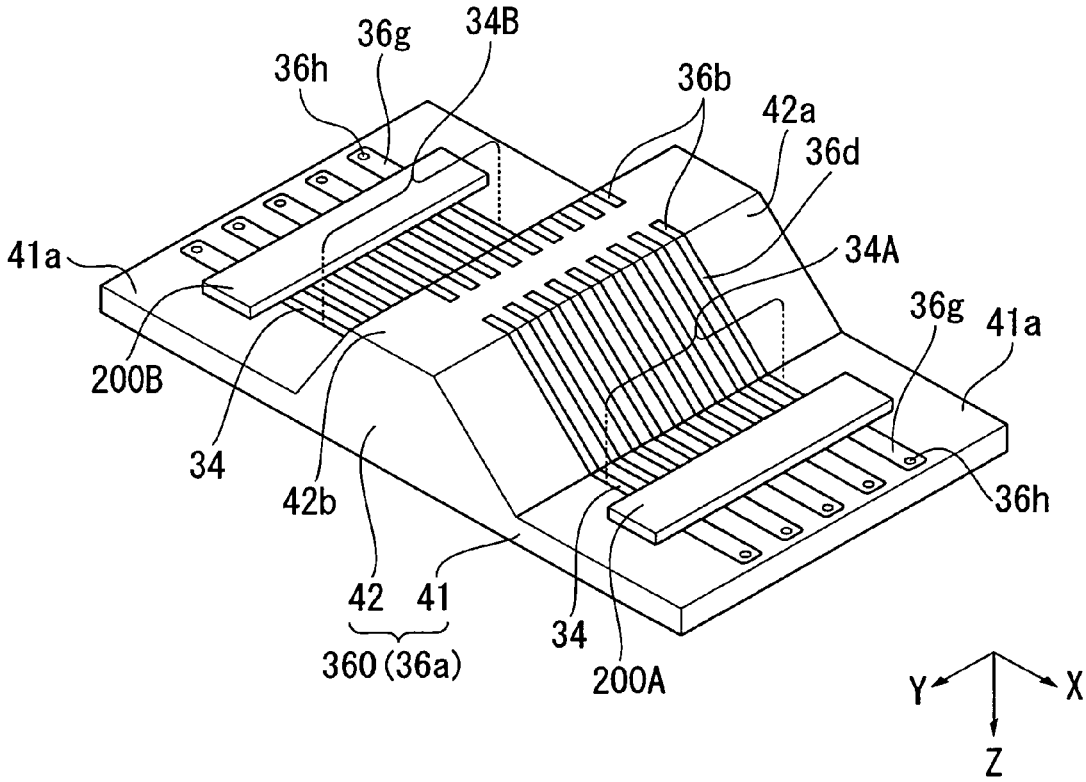
FIG. 8 is a perspective view of a connector.
Figure 9:
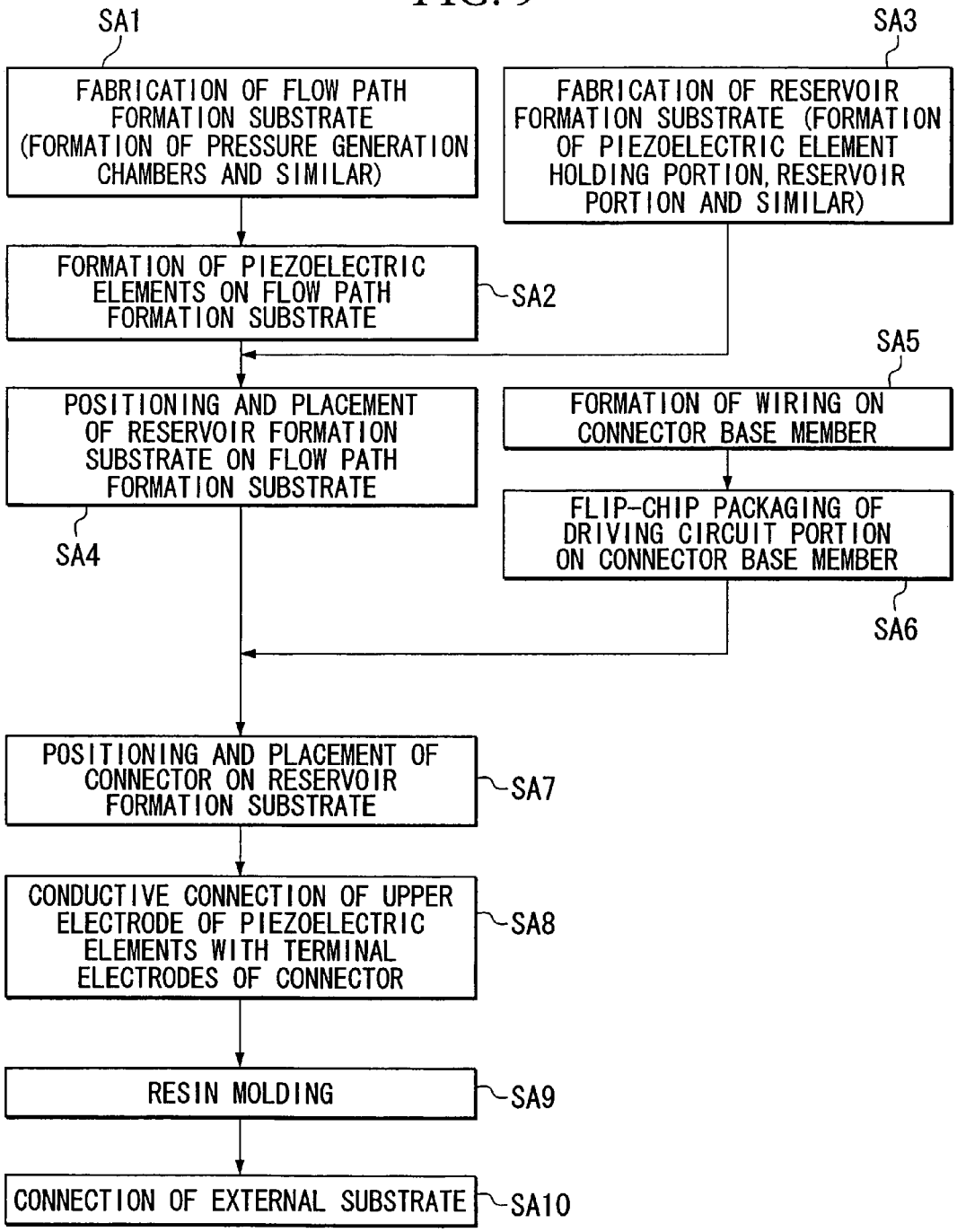
FIG. 9 is a view of flowchart showing a method of manufacture of a liquid drop ejection head.

Next, a second embodiment of a liquid drop ejection head, provided with a device package structure of this invention, is explained referring to FIG. 6 through FIG. 8. FIG. 6 is an exploded perspective view showing the embodiment of the liquid drop ejection head, FIG. 7 shows a cross-section of the configuration along line A-A in FIG. 6, and FIG. 8 is an external perspective view of the connector viewed from the rear surface side (the bottom side in FIG. 6).

In these figures, components which are the same as the constituent components in the first embodiment shown in FIG. 1 through FIG. 5 are assigned the same symbols, and an explanation is omitted.

As shown in FIG. 8, the connector 360 in this embodiment is provided with a rectangular plate-shape flat plate portion (plate portion) 41, and a connector base member 36*a* having a protruding portion 42 which protrudes from the flat plate portion 41. Here, the protruding portion 42 protrudes in the −Z direction on the upper surface (first surface) 41*a* of the flat plate portion 41, and is shaped such that the width in the X direction decreases in moving toward the −Z direction. The protruding portion 42 has inclined surfaces 42*a*, inclined at an obtuse angle from the upper surface 41*a* of the flat plate portion 41, and a tip surface (second surface) 42*b*, formed at the tip of the flat plate portion and parallel to the upper surface 41*a* of the flat plate portion 41. Driving circuit sections 200A and 200B are packaged on both sides of the protruding portion 42 so as to enclose the protruding portion 42 on two sides on the upper surface 41*a* the flat plate portion 41.

On the flat plate portion 41, a plurality of wiring terminals 36*g*, connected to the driving circuit sections 200A and 200B, are formed, arranged extending in the X direction. The plurality of wiring terminals 36*g* are formed on the side opposite the wiring patterns 34, as viewed from the driving circuit sections 200A and 200B. At the tips of each of the wiring electrodes 36*g* are formed minute through-holes (penetrating holes) 36*h* which penetrate the flat plate portion 41 in the thickness direction (see FIG. 7). On the inner surfaces of the through-holes 36*h* are formed wiring electrodes 36*j*, which are thin films of for example gold (Au) or the like, and which are connected to the wiring electrodes 36*g*. As the wiring electrodes 36*j*, in addition to a configuration in which a film is formed on the inner surfaces of the through-holes 36*h*, a configuration in which the interiors of the through-holes 36*h* are filled may be used.

On the other hand, connection pads (connection electrodes) 36*k*, for connection to external equipment (an external substrate 45, see FIG. 6), are formed on the surface of the flat plate portion 41 opposite the upper surface 41*a*, that is, the back surface 41*c* in the +Z direction. The connection pads 36*k* are formed to correspond to the through-holes 36*h* (wiring electrodes 36*j*). A wiring electrode 36*m* is formed between each connection pad 36*k* and wiring electrode 36*j*. The wiring electrodes 36*m* are electrically connected to the connection pads 36*k* and wiring electrodes 36*j*. These wiring electrodes 36*g*, 36*j*, 36*m* are the second connection wiring of this invention, which electrically connect the driving circuit sections 200A and 200B to the connection terminals 200*a* and connection pads 36*k*, is configured.

The terminal electrodes 36*b*, wiring patterns 34, connection wiring (first connection wiring) 36*d*, bumps 36*e*, wiring electrodes 36*g*, 36*j*, 36*m*, and connection pads 36*k* of the connector terminals can be formed from a metal material, conductive polymer, superconductor, or the like. It is preferable that the material of the connector terminals be Au (gold), Ag (silver), Cu (copper), Al (aluminum), Pd (palladium), Ni (nickel), or another metal material. In particular, it is preferable that the bumps 36*e* on the terminal electrodes 36*b* be formed from Au. This is because when Au bumps are used for the connection terminals 200*a* of the driving circuit sections 200A and 200B, a reliable connection can easily be obtained in the Au—Au connection.

Upon flip-chip packaging of the driving circuit sections 200A and 200B onto the wiring patterns 34 and terminal electrodes 36*g* also, conductive connection structures can be adopted which employ the above metal crimp contacts, brazing metals, and anisotropic conductive films, anisotropic conductive pastes, and other anisotropic conductive materials, as well as non-conductive films, non-conductive pastes, and other insulating resin materials.

Otherwise the configuration is similar to that of the first embodiment above.

In order to use a liquid drop ejection head 1 having the above-described configuration to eject drops of a functional liquid, an external functional liquid supply device, not shown, connected to the functional liquid intake 25, is driven by an external controller (not shown) connected at connection pads 36*k* to the liquid drop ejection head 1 via an external substrate 45. Functional liquid sent from the external functional liquid supply device is supplied to the reservoir 100 via the functional liquid intake 25, after which the flow path within the liquid drop ejection head 1 up to the nozzle apertures 15 is filled.

The external controller transmits driving power and command signals to the driving circuit sections 200A and 200B packaged on the reservoir formation substrate 20, via the wiring electrodes 36*m*, 36*j*, and 36*g*. Upon receiving a command signal and similar, the driving circuit sections 200A and 200B transmit a driving signal, based on the command from the external controller, to each of the piezoelectric elements 300 electrically connected via the wiring patterns 34 and terminal electrodes of the connector 360.

Then, as a result of application of a voltage across the lower electrode film 60 and upper electrode film 80 corresponding to the respective pressure generation chambers 12, displacement occurs in the elastic film 50, lower electrode film 60 and piezoelectric film 70, and as a result of this displacement the volume of each of the pressure generation chambers 12 changes, the internal pressure rises, and liquid drops are ejected from the nozzle apertures 15.

No particular constraints are placed on the method of formation of the through-holes 36*h* in the flat plate portion 41, and any method may be used, for example, laser machining or dry etching may be employed to form holes with comparatively high precision and at high density.

Next, as an example of a method of manufacture of the connector 360, a method of formation of connector terminals (terminal electrodes 36*b*, wiring patterns 34, connection wirings 36*d*, and bumps 36*e*) and wiring electrodes 36*g* using a liquid drop ejection method is explained. In this embodiment, a case is explained in which a ceramic molded body with a convex shape in cross-section is used as the connector base member 36*a*, but the explanation is similar when using connector base members of other materials as well.

To form connector terminals using a liquid drop ejection method, a liquid drop ejection apparatus having the liquid drop ejection head 1 is suitable for use. That is, ink used to form the connector terminals is ejected from the liquid drop ejection head 1 provided in the liquid drop ejection apparatus, to place ink on the upper surface 41*a* of the connector base member 36*a*, forming a prescribed pattern. Thereafter, the ink on the connector base member 36*a* is dried and baked, to form a metal thin film. By repeating the above process, in order, for the tip surface 42*b* and inclined surfaces 42*a* of the protruding portion 42 and for the upper surface 41*a* of the flat plate portion 41, the terminal electrodes 36*b* and wiring patterns 34, as well as the connection wirings 36*d*, bumps 36*e*, and wiring terminals 36*g* connected thereto can be formed on the connector base member 36*a*.

Similarly, ink can be ejected, followed by drying and baking, to form metal thin film for the wiring electrodes 36*m* and connection pads 36*k*, forming a prescribed pattern on the surface in the +Z direction of the connector base member 36*a*.

A flowchart of the method of manufacture of a liquid drop ejection head of this embodiment is similar to that of the first embodiment, shown in FIG. 5, but in this embodiment, the terminal electrodes 36*b*, wiring patterns 34, and the connection wirings 36*d*, bumps 36*e*, and wiring electrodes 36*g*, 36*j*, and 36*m* connected thereto, as well as the connection pads 36*k* and other wiring, are formed on the connector base member 36*a* in step SA5, which is a process separate from steps SA1 to SA4. Next, in step SA6 the above-described flip-chip packaging is used to package the driving circuit sections 200A and 200B in a prescribed area (packaging area) on the connector base member 36*a*, to form the connector 360.

Then, in step SA9 a non-conductive resin 46 is used to seal the connector 360 and reservoir formation substrate 20 using resin molding.

Following this the external substrate 45 (see FIG. 6) is connected at the connection pads 36*k* (step SA10). In the above processes, the liquid drop ejection head 1 can be manufactured.

In connecting the external substrate 45, a procedure may be used in which, prior to connecting the connector 360 and the flow path formation substrate 10, the connector 360 is first connected to the external substrate 45, and the connector 360, to which the external substrate 45 is connected, is then connected to the flow path formation substrate 10.

Otherwise the method of connector manufacture, procedure for formation of connector terminals, and method of manufacture of a liquid drop ejection head are similar to those of the first embodiment.

In this embodiment, in addition to obtaining action and advantageous results similar to those of the above first embodiment, a configuration is employed in which an external substrate 45 is connected at connection pads 36*k* provided on the connector 360, so that there is no need to provide a substrate for connection which projects outside the connector 360. Hence, the position of the functional liquid intake 25 can also be near the center, and a compact liquid drop ejection head 1 can be realized.

Furthermore, in this embodiment the connection pads 36*k* for connection to an external substrate 45 are provided on the back surface 41*c* (on the surface in the +Z direction of the flat plate portion 41), that is, the connection pads 36*k* are formed on the exposed surface on the side opposite the liquid drop ejection head 1, so that the task of connection with an external substrate 45 or other external equipment is made easy, further contributing to improved manufacturing efficiency.

Figure 10:
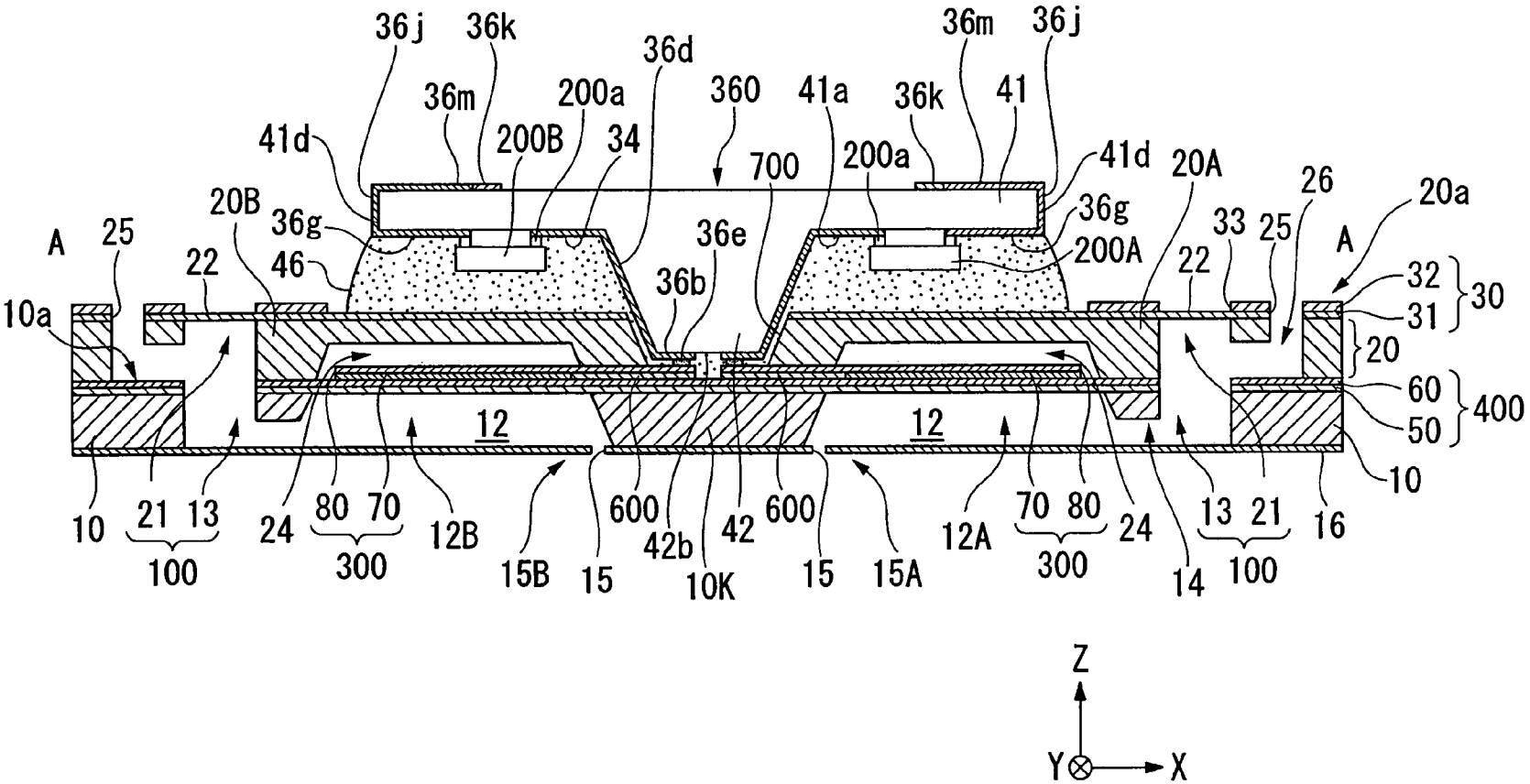
FIG. 10 is a cross-sectional view of an example of the liquid drop ejection head of another embodiment.

In the above embodiment, through-holes 36*h* which penetrate the flat plate portion 41 are provided, and wiring electrodes 36*j* are formed on the inner surfaces of these through-holes 36*h*, however, this invention is not limited to such a configuration. Configurations for connecting the wiring electrodes 36*g* and 36*m* formed on the two sides of the flat plate portion 41 include, for example, a configuration in which the wiring electrodes 36*g*, 36*m* are formed up to the edge of the flat plate portion 41, and wiring electrodes 36*j* are formed on the side surface 41*d* of the flat plate portion 41 so as to connect the wiring electrodes 36*g* and 36*m*, as shown in FIG. 10.

Third Embodiment

Figure 11:
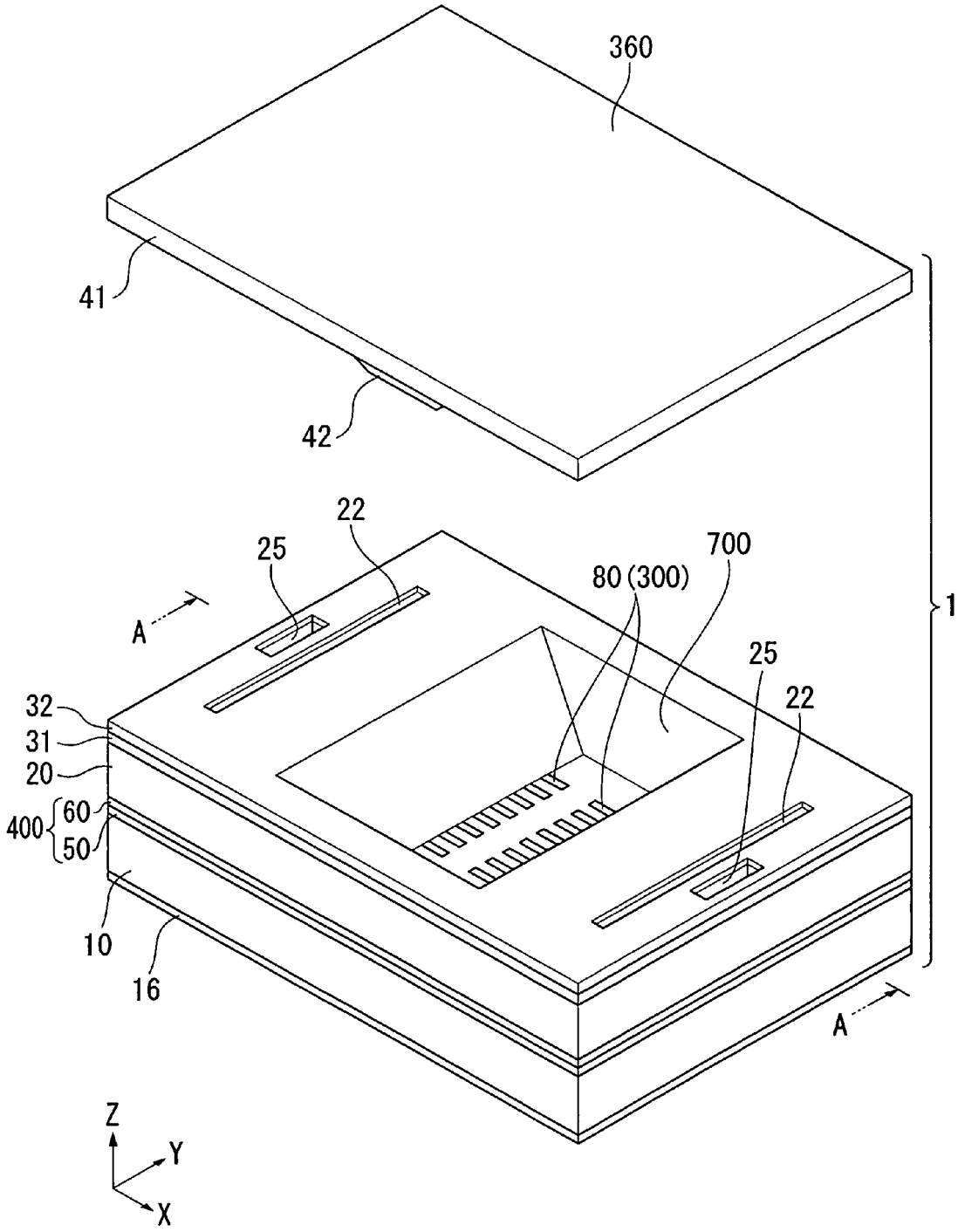
FIG. 11 is a perspective view of a liquid drop ejection head of a third embodiment of the invention.
Figure 12:
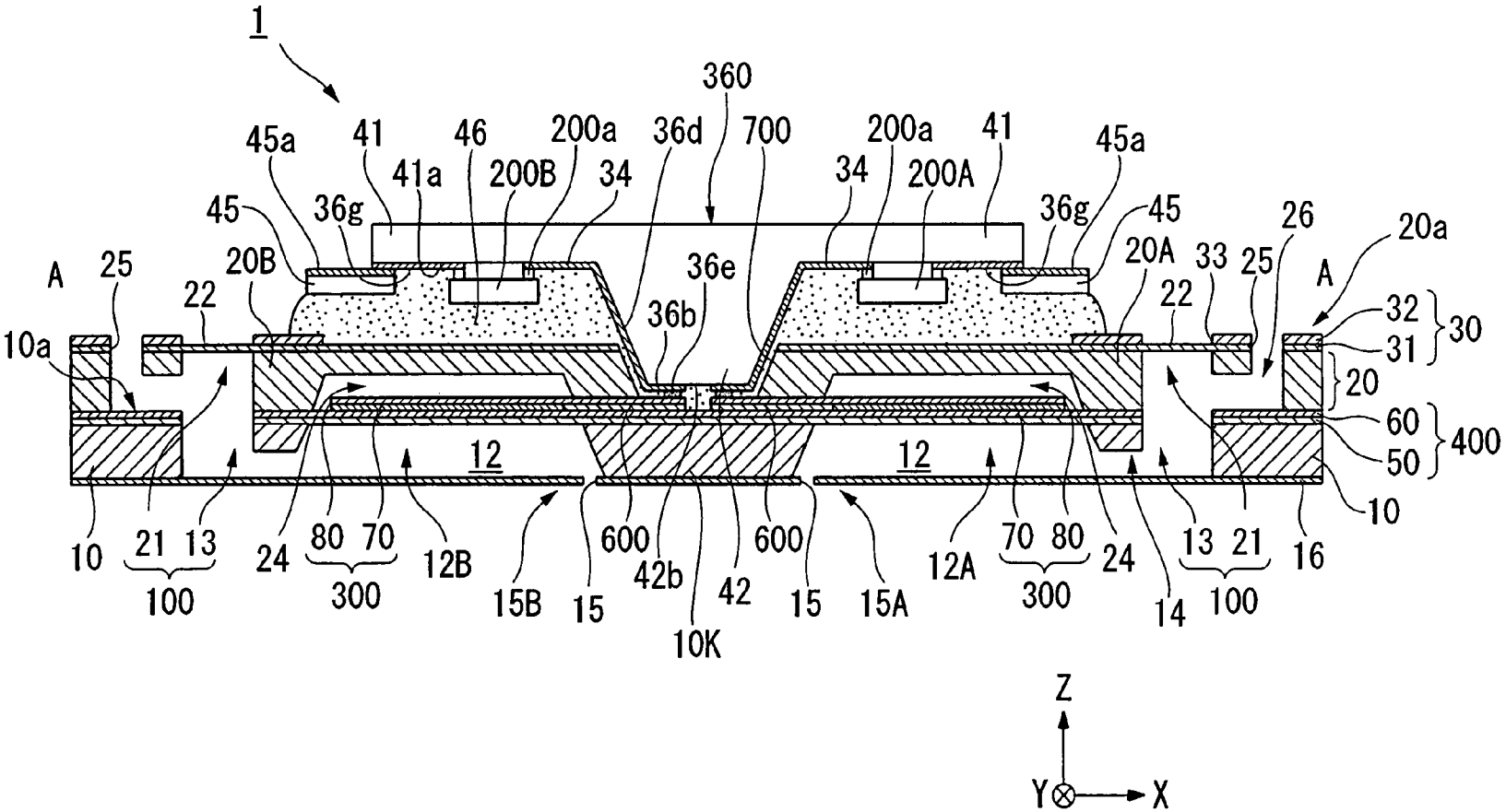
FIG. 12 is a cross-sectional view of the configuration of the liquid drop ejection head, taken along line A-A in FIG. 11.
Figure 13:
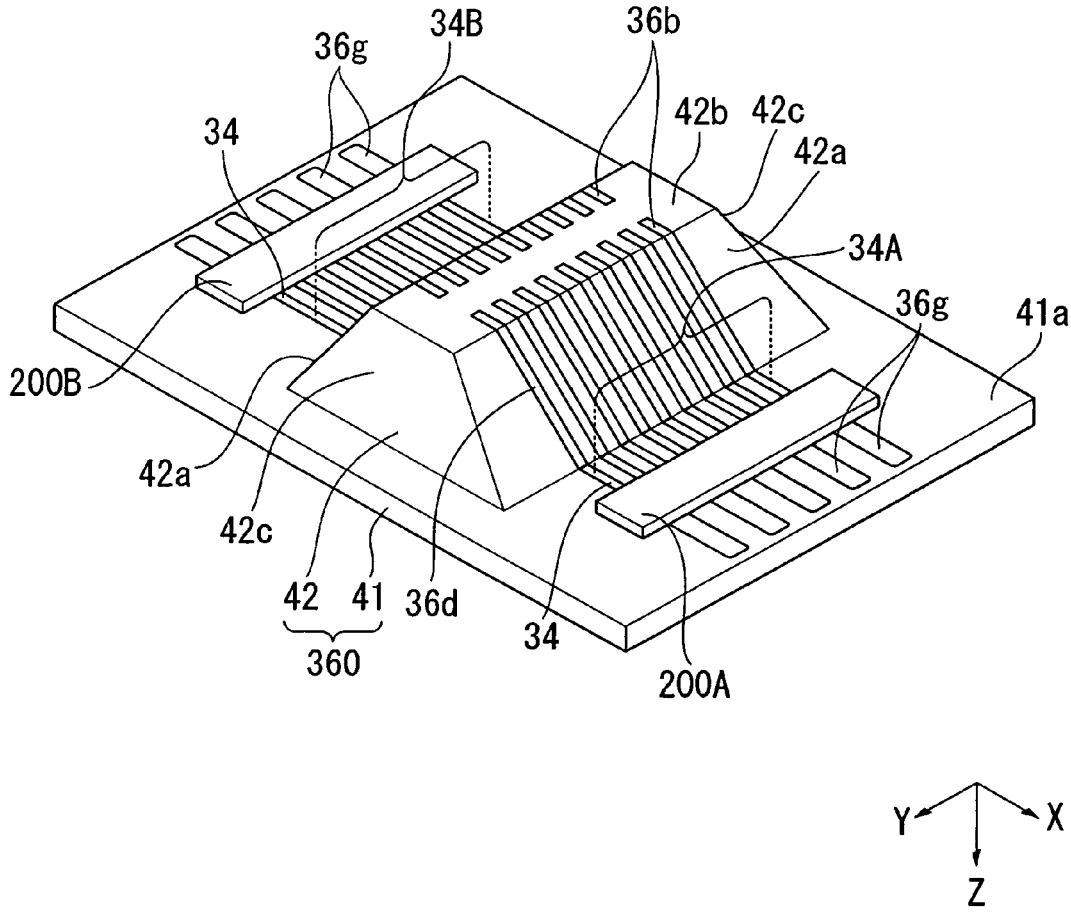
FIG. 13 is a perspective view of a connector.

Next, a third embodiment of a liquid drop ejection head provided with the device package structure of this invention is explained, referring to FIG. 11 through FIG. 13. FIG. 11 is an exploded perspective view showing an embodiment of a liquid drop ejection head, FIG. 12 is a cross-sectional view along line A-A in FIG. 11, and FIG. 13 is a perspective view viewed from the rear-surface side of the connector (the lower side in FIG. 6).

In these figures, components which are the same as the constituent components in the first embodiment shown in FIG. 1 through FIG. 5 are assigned the same symbols, and an explanation is omitted.

As shown in FIG. 11 and FIG. 12, a groove portion (depression portion) 700, which is rectangular in shape as viewed from the direction perpendicular to the reservoir formation substrate 20 (the −Z direction), and the x-direction width and Y-direction width of which decrease in moving downward (a quadrangular truncated pyramid shape), is formed in the center of the reservoir formation substrate 20. In the liquid drop ejection head of this embodiment, this groove portion 700 forms a level difference portion which separates the upper electrode film 80 (circuit connection portions) of the piezoelectric elements 300 from the connection terminals 200*a* of the driving circuit sections 200A and 200B to which these are to be connected.

As shown in FIG. 13, the connector 360 of this embodiment is provided with a connector base member 36*a*, having a rectangular plate-shaped flat plate portion (plate portion) 41 and a protruding portion 42 which protrudes from the flat plate portion 41. Here, the protruding portion 42 protrudes in the −Z direction from the upper surface (first surface) 41*a* of the flat plate portion 41, and is shaped such that the width in the X and Y directions decreases in moving toward the −Z direction. Thus the protruding portion 42 has inclined surfaces 42*a* which are inclined at an obtuse angle from the upper surface 41*a* of the flat plate portion 41, inclined surfaces 42*c* (first contact surface, second contact surface) which are inclined at an obtuse angle from the upper surface 41*a* of the flat plate portion 41, and a tip surface (second surface) 42*b*, formed at the tip of the flat plate portion 41 and parallel to the upper surface 41*a* of the flat plate portion 41. On the upper surface 41*a* of the flat plate portion 41 are packaged driving circuit sections 200A and 200B on either side of the protruding portion 42, so as to enclose the protruding portion 42 on two sides.

On the upper surface 41*a* of the flat plate portion 41, wiring patterns 34 are formed from the driving circuit sections 200A and 200B toward the protruding portion 42. The plurality of wiring terminals 36*g* connected to the driving circuit sections 200A and 200B are formed in an arrangement extending in the X direction. The plurality of wiring terminals 36*g* are formed on the side opposite the wiring patterns 34 as viewed from each of the driving circuit sections 200A and 200B. Each of the plurality of wiring terminals 36*g* is connected to a driving circuit section 200A or 200B, and is formed arranged in the Y direction and extending in the X direction.

The tips of these wiring terminals 36*g* are connected to lead terminals 45*a* of a flexible external substrate (FPC substrate or the like) used for connection with an external controller or the like (see FIG. 12). Here, the lead terminals 45*a* are formed in the surface in the +Z direction in FIG. 12.

Figure 14A:
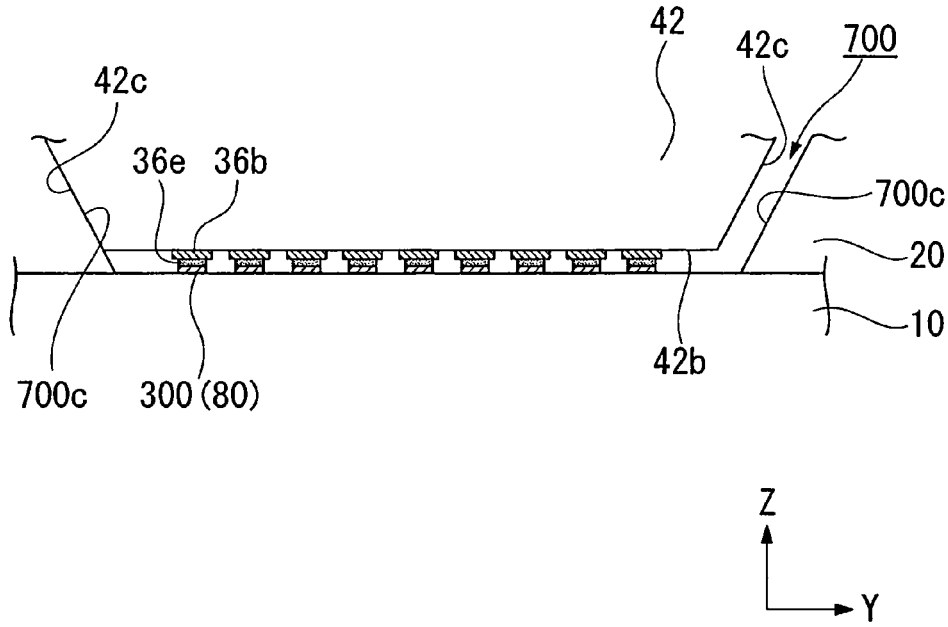
FIGS. 14A and 14B are cross-sectional views in the Y-axis direction of the connector and, groove portion.
Figure 14B:
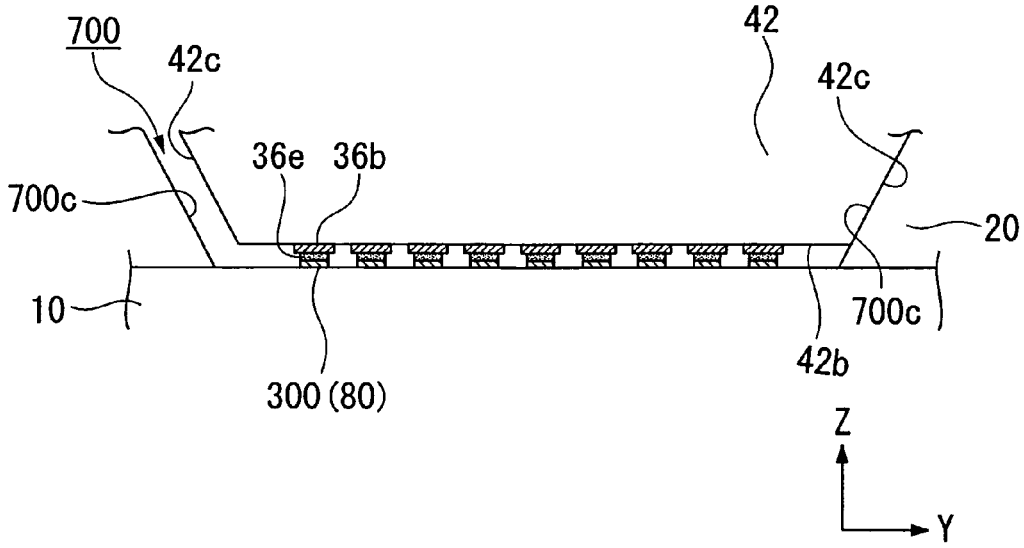

As shown in FIG. 12, the inclined surfaces 42*a* of the protruding portion 42 are held with a gap intervening with the groove portion 700 of the reservoir formation substrate 20. In addition, as shown in FIGS. 14A and 14B, the width of the bottom of the groove portion 700 is formed to be larger than the width of the tip surface 42*b* of the protruding portion 42 in the Y direction. Furthermore, inner wall surfaces (a first and second inner wall surface) 700*c*, parallel to the inclined surfaces (first and second contact surfaces) of the groove portion 700, are formed. In FIG. 14A, contacting between the inclined surface 42*c* which is the first contact surface and the first inner wall surface 700*c* of the flow path formation substrate 10, the flow path formation substrate 10 of the protruding portion 42 is positioned, and each of the plurality of terminal electrodes 36*b* is connected to each of the plurality of upper electrode film portions 80. In FIG. 14B, contacting between the inclined surface 42*c* which is the second contact surface and the second inner wall surface 700 of the flow path formation substrate 10, the flow path formation substrate 10 of the protruding portion 42 is positioned, and each of the plurality of terminal electrodes 36*b* is connected to each of the plurality of upper electrode film portions 80.

In both FIG. 14A and FIG. 14B, the height of the protruding portion 42 (Z-direction length) is greater than a depth of the groove portion 700, more specifically, when the protruding portion 42 is inserted into the groove portion 700, the driving circuit sections 200A and 200B packaged on the upper surface 41*a* (the lower surface in FIG. 12) of the flat plate portion 41 are set to a size such that there is no contact with the (upper surface 20*a* of the) reservoir formation substrate 20.

In the connector 360, a connection wiring 36*d* and a bump 36*e* to connect a terminal electrode 36*b* with a wiring pattern 34 form a single connector terminal. Such connector terminals are arranged on the connector base member 36*a* at a pitch equal to the pitch of the upper electrode film portions 80 projecting into the groove portion 700 shown in FIG. 12. These connector terminals are formed individually and with high precision on the first or the second contact surface of the protruding portion 42.

Figure 15:
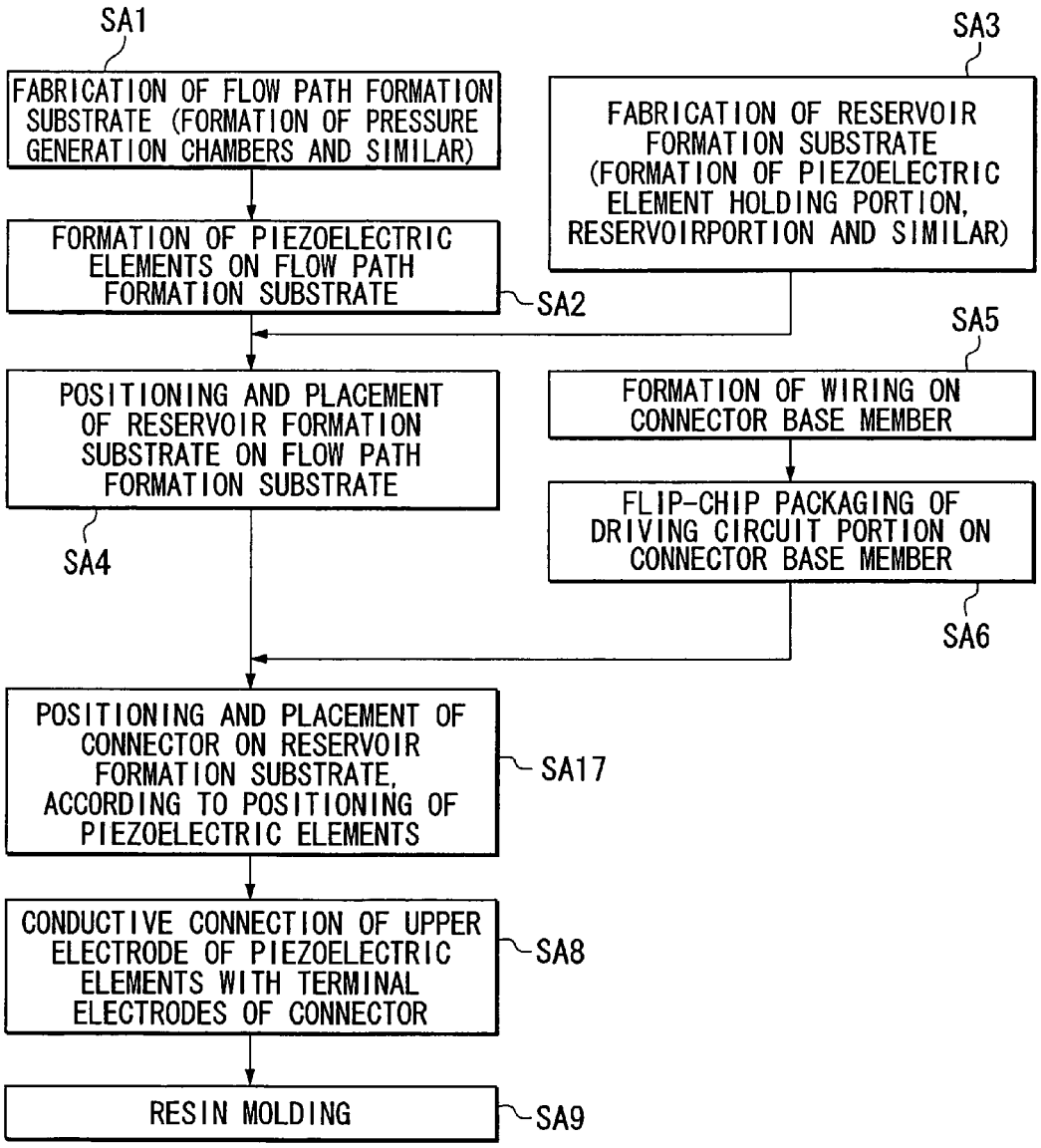
FIG. 15 is a view of flowchart showing a method of manufacture of a liquid drop ejection head.

The flowchart of the method of manufacture of the liquid drop ejection head of this embodiment is similar to that of the first embodiment shown in FIG. 5, in this embodiment, as shown in FIG. 15, the connector 360 formed upon completing step SA6 is, in step SA17, positioned above the reservoir formation substrate 20 according to the placement of the piezoelectric elements 300. Then, the protruding portion 42 is inserted into the groove portion 700, and the terminal electrodes 36*b* (bumps 36*e*) are electrically connected to the upper electrode film portions 80 (circuit connection portions) of the piezoelectric elements 300 (step SA8).

When a plurality of flow path formation substrates 10 are formed on one wafer in order to improve manufacturing efficiency, in the interest of efficiency in forming wiring, the piezoelectric elements 300, consisting of the piezoelectric film 70 and upper electrode film 80, may be formed in proximity between a plurality of flow path formation substrates, without leaving a distance therebetween. In this case, when flow path formation substrates 10 are divided by dicing of the wafer, the relative positions of the piezoelectric elements 300 are not constant, and there may for example be a plurality of positions.

To take one example, there are cases in which the piezoelectric elements 300 on the flow path formation substrate 10 are shifted toward the −Y side relative to the groove portion 700 of the reservoir formation substrate 20, as shown in FIG. 14A, and there are cases in which the piezoelectric elements 300 on the flow path formation substrate 10 are shifted toward the +Y side relative to the groove portion 700 of the reservoir formation substrate 20, as shown in FIG. 14B (in FIGS. 14A and 14B, the piezoelectric film 70 and the upper electrode film 80 are shown as a single layer of piezoelectric elements 300).

Consequently, when the protruding portion 42 is inserted into the groove portion 700, the protruding portion 42 is inserted at a position corresponding to placement of the piezoelectric elements 300 relative to the groove portion 700, which is known in advance. That is, in the case of placement of piezoelectric elements 300 such as shown in FIG. 14A, the inclined surface 42*c* on the −Y side of the protruding portion 42 and the inner wall surface 700*c* on the −Y side of the groove portion 700 are contacted, the connector 360 is supported by the groove portion 700, and the protruding portion 42 is inserted into the groove portion 700 so that the bumps 36*e* make contact with the piezoelectric elements 300. On the other hand, in the case of placement of the piezoelectric elements 300 as shown in FIG. 14B, the inclined surface 42*c* on the +Y side of the protruding portion 42 and the inner wall surface 700*c* on the +Y side of the groove portion 700 are contacted, the connector 360 is supported by the groove portion 700, the protruding portion 42 is inserted into the groove portion 700, and the bumps 36*e* make contact with the piezoelectric elements 300.

At this time, even when the protruding portion 42 and the groove portion 700 (reservoir formation substrate 20) make contact, because no wiring is formed on the inclined surface 42*c*, there is no occurrence of short-circuits across terminals. Hence, it is possible to position the protruding portion 42 (connector 360) into the groove portion 700 easily, by the position at which the first inner wall surface and the first contact surface are contacted, or by the position at which the second inner wall surface and the second contact surface are contacted.

Connection at this time can adopt the above-described flip-chip packaging method using pressurized heating and ultrasonic vibration, employing metal crimp contacts, brazing metals, anisotropic conductive film (ACF), anisotropic conductive paste (ACP) and other anisotropic conductive materials, non-conductive film (NCF), non-conductive paste (NCP), and other insulating resin materials. When adopting an ultrasonic heating method, in order that the vibrations applied to the connector 360 do not adversely affect the precision of connections between terminal electrodes 36*b* arranged in the Y direction and the upper electrode film 80, it is preferable that vibrations be applied in the X direction, orthogonal to (perpendicular to) the direction of arrangement.

Otherwise the connector manufacturing method, procedure for formation of connector terminals, and liquid drop ejection head manufacturing method are similar to those of the first embodiment.

In this embodiment, in addition to obtaining action and advantageous results similar to those of the above first embodiment, even when the placement of piezoelectric elements 300 relative to the groove portion 700 is not constant, as in cases where the wafer is divided and flow path formation substrates 10 are formed, the groove portion 700 is formed to be larger than the length of the protruding portion 42 of the connector 360, and by appropriately choosing the position for insertion of the protruding portion 42 into the groove portion 700 according to the placement of the piezoelectric elements 300, the piezoelectric elements 300 and connector terminals can be smoothly and reliably connected. In particular, in this embodiment one of the inclined surfaces 42*c* of the protruding portion 42 is made to support an inner wall surface 700*c* of the groove portion 700 to obtain connection, so that the task of connection is simplified, contributing to improved efficiency. Furthermore, in this embodiment the supported member is an inclined surface, so that catching of the tip of the protruding portion 42 on the entrance to the groove portion 700 during insertion into the groove portion 700, and consequent damages and impediment of the insertion task, can be prevented.

In this embodiment, the connector 360 has inclined surfaces 42*a*, which provide guidance during insertion of the protruding portion 42 into the groove portion 700 and enable stable connection, in addition, because the protruding portion 42 having the inclined surfaces 42*a* is held by the groove portion 700 with a gap therebetween, short-circuiting between terminals due to contact of wiring patterns 42 with the connector 360 can be prevented.

Furthermore, in this embodiment the angle between the tip surface 42*b* and the inclined surfaces 42*a* is an obtuse angle, and the angle between the upper surface 41*a* and the inclined surfaces 42*a* is an obtuse angle, so that concentration of stress on terminal electrodes formed at points of intersection of surfaces can be relaxed, and broken wires and other problems can be avoided. In addition, there is the further advantageous result that formation of wiring on the inclined surfaces 42*a* is easier than when the angle between the tip surface 42*b* and the inclined surfaces 42*a*, and the angle between the upper surface 41*a* and the inclined surfaces 42*a*, is a right angle.

Liquid Drop Ejection Apparatus

Figure 16:
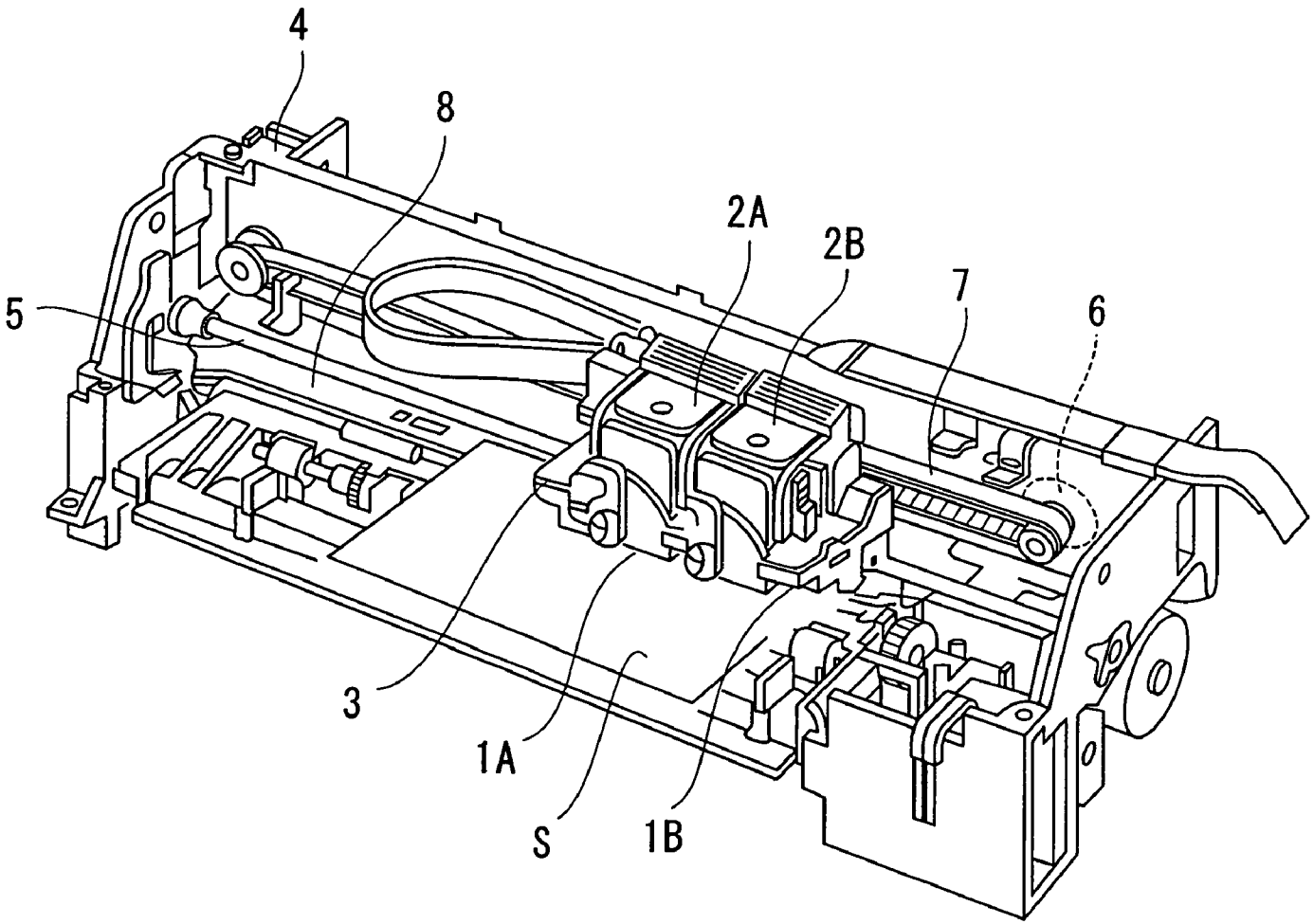
FIG. 16 is a perspective view of an example of a configuration of a liquid drop ejection apparatus.

Next, an example of a liquid drop ejection apparatus provided with the above-described liquid drop ejection head 1 is explained, referring to FIG. 16. In this example, an inkjet recording apparatus provided with the above-described liquid drop ejection head is described as one example of such an apparatus.

The liquid drop ejection head constitutes one portion of a recording head unit provided with an ink flow path communicated to an ink cartridge or the like, and is mounted in an inkjet recording apparatus. As shown in FIG. 16, cartridges 2A and 2B, constituting ink supply sections, are removably provided in the recording head units 1A and 1B having liquid drop ejection heads, a carriage 3 in which these recording head units 1A and 1B are mounted is installed on a carriage shaft installed in the apparatus main unit 4, in a manner enabling free movement in the shaft direction.

The recording head units 1A and 1B eject, for example, a black ink composition and a color ink composition respectively. By transferring the driving force of a driving motor 6 to the carriage 3, via a plurality of gears, not shown, and a timing belt 7, the carriage 3 on which are mounted the recording head units 1A and 1B moves along the carriage shaft 5. On the other hand, a platen 8 is provided in the apparatus main unit 4 along the carriage shaft 5, and a recording sheet S, which is paper or other recording media, is transported onto the platen 8 by a paper feed roller or other sections, not shown. An inkjet recording apparatus provided with the above configuration is provided with the above-described liquid drop ejection head, so that the inkjet recording apparatus is compact, highly reliable, and is produced at reduced cost.

In FIG. 16, an inkjet recording apparatus is shown as a printer unit which is one example of a liquid drop ejection apparatus of this invention. However, this invention is not limited to such an apparatus, and application to any printer unit which is realized through combination with the liquid drop ejection head is possible. Such a printer unit may for example be installed in a television set or other display device, or in a white board unit or other input device, for use in printing images which have been displayed on or input to the display device or input device.

The above liquid drop ejection head can also be applied to a liquid drop ejection apparatus used to form various devices by a liquid ejection method. In this mode of use, as the functional liquid ejected by the liquid drop ejection head, an organic EL formation material for formation of an organic EL (electroluminescence) display device, a wiring pattern formation material for forming electronic circuit wiring patterns, and similar can be used. In a manufacturing process which selects and places such functional liquids on a base member using a liquid drop ejection apparatus, a functional material pattern can be placed without the need for a photolithography process, so that liquid crystal display devices, organic EL devices, circuit boards, and other devices can be manufactured inexpensively.

In the above, preferred embodiments of this invention have been explained, referring to the attached drawings. However, the invention is not limited to these embodiments. The shapes, combinations and similar of constituent members described in the above are only examples, and various modifications are possible based on design requirements and similar, within the range in which there is no deviation from the gist of the invention.

For example, in the above embodiments, bumps are provided on the connector 360, but the invention is not limited thereto, and a configuration is possible in which bumps are provided on the upper electrode film 80. Also, in the above embodiments the groove portion 700 and the protruding portion 42 of the connector 360 are both formed into a tapered shape, but a configuration may be employed in which either one, or both, are formed with the same width.

In an embodiment above, an example of a liquid drop ejection head in which driving circuit sections 200A and 200B are packaged on a base body as devices, but the invention is not limited thereto, and application to a semiconductor device having a structure in which electronic devices are packaged three-dimensionally is also possible.

In the above embodiments, two rows of nozzles (first and second nozzle aperture groups) were provided, but the invention is not limited thereto, and configurations in which either a single row is provided, or three or more rows are provided, are possible. For example, in a case in which a single nozzle row is provided, a shape is possible in which the connector 360 shown in FIG. 13 is divided at the center in the X direction.

What is claimed is:

1. A device package structure, comprising:

a base body having a depression portion and a conductive connection portion formed in the depression portion;

a device having a connection terminal; and a connector having a plate portion having a first surface on which the device is positioned, a protruding portion protruding from the first surface of the plate portion and having a second surface different from the first surface, a terminal electrode formed on the second surface, and a connection wiring electrically connecting the connection terminal of the device and the terminal electrode, wherein the protruding portion of the connector is inserted into the depression portion of the base body, the terminal electrode is connected to the conductive connection portion, and the conductive connection portion is electrically connected to the connection terminal of the device.

2. The device package structure according to claim 1, wherein a height from the first surface of the plate portion to the second surface of the protruding portion is greater than a depth of the depression portion.

3. The device package structure according to claim 1, further comprising:

an external substrate; and a wiring terminal formed on the first surface of the plate portion and electrically connecting the device and the external substrate.

4. The device package structure according to claim 1, wherein the connector has an inclined surface between the first surface of the plate portion and the second surface of the protruding portion, and the connection wiring is formed on the inclined surface.

5. The device package structure according to claim 1, further comprising:

a conductive protuberance formed on the terminal electrode.

6. The device package structure according to claim 1, wherein a linear expansion coefficient of the base body and a linear expansion coefficient of the connector are substantially the same.

7. The device package structure according to claim 1, further comprising:

a conductive protuberance formed on the connection terminal of the device.

8. The device package structure according to claim 1, further comprising:

a resin formed between the first surface of the connector and the base body.

9. A liquid drop ejection head, comprising:

a nozzle aperture ejecting liquid drops;

a pressure generation chamber communicating with the nozzle aperture;

a driving element arranged outside of the pressure generation chamber, having a circuit connection portion, and generating a pressure change in the pressure generation chamber;

a protective substrate provided on an opposite side of the pressure generation chamber in relation to the driving element; and a driving circuit section, provided on an opposite side of the driving element in relation to the protective substrate, supplying electrical signals to the driving element, wherein the circuit connection portion is electrically connected to the driving circuit section by using the device package structure according to claim 1.

10. A semiconductor device, comprising:

a base body; and an electronic device packaged on the base body by using the device package structure according to claim 1.

11. A connector, comprising:

a device having a connection terminal;

a plate portion having a first surface on which the device is positioned;

a protruding portion protruding from the first surface of the plate portion, and having a second surface different from the first surface;

a terminal electrode formed on the second surface; and a connection wiring electrically connecting the connection terminal of the device and the terminal electrode.

12. The connector according to claim 11, further comprising:

an inclined surface between the first surface of the plate portion and the second surface of the protruding portion, wherein the connection wiring is formed on the inclined surface.

13. The connector according to claim 11, further comprising:

a conductive protuberance formed on the terminal electrode.

14. The connector according to claim 11, further comprising:

a conductive protuberance formed on the connection terminal of the device.

* * * * *